US006863358B2

(12) United States Patent
Beyer et al.

(10) Patent No.: US 6,863,358 B2
(45) Date of Patent: Mar. 8, 2005

(54) STORAGE CABINET WITH MOVABLE DOOR

(75) Inventors: Peter J. Beyer, Manlius Township, Allegan County, MI (US); Steven J. King, Park Township, Ottawa County, MI (US); Mark A. Powell, Robinson Township, Ottawa County, MI (US); Bryan L. Roels, Heath Township, Allegan County, MI (US); Thomas F. Ysseldyke, Blendon Township, Ottawa County, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 10/375,757

(22) Filed: Feb. 26, 2003

(65) Prior Publication Data

US 2003/0160551 A1 Aug. 28, 2003

Related U.S. Application Data

(60) Provisional application No. 60/360,484, filed on Feb. 28, 2002.

(51) Int. Cl.[7] ..... E06B 9/15; A47B 88/00

(52) U.S. Cl. ..... 312/323; 312/328; 312/297

(58) Field of Search ..... 312/323, 310, 312/311, 297, 298, 295, 326, 328, 329

(56) References Cited

U.S. PATENT DOCUMENTS

| | | | | | |
|---|---|---|---|---|---|
| 169,028 | A | * | 10/1875 | Nichols | 312/297 |
| 287,475 | A | | 10/1883 | Ross | 312/297 X |
| 344,212 | A | | 6/1886 | Stephens | 312/297 |
| 446,647 | A | * | 2/1891 | Rankin et al. | 312/297 X |
| 1,181,739 | A | | 5/1916 | Clark | |
| 1,471,781 | A | | 10/1923 | Eagle | |
| 1,667,564 | A | | 4/1928 | Pearson | |
| 1,742,821 | A | | 1/1930 | Nichols | |
| 1,930,348 | A | | 10/1933 | Parrott | 312/297 X |
| 2,241,179 | A | | 5/1941 | Brenkert | |
| 2,578,125 | A | | 12/1951 | Brotman | |
| 3,730,378 | A | | 5/1973 | Albinson et al. | |
| 5,222,790 | A | * | 6/1993 | Latino | 312/323 X |
| 5,758,937 | A | * | 6/1998 | Lammens et al. | 312/323 X |
| 5,857,363 | A | | 1/1999 | Jung et al. | |
| 5,882,099 | A | | 3/1999 | Salice | 312/328 |
| 6,227,635 | B1 | | 5/2001 | Teppo et al. | 312/328 |
| 6,234,595 | B1 | * | 5/2001 | Maple et al. | 312/323 |
| 6,296,337 | B1 | * | 10/2001 | Kawanabe | 312/323 X |
| 6,394,564 | B1 | * | 5/2002 | Mrotz, et al. | 312/323 X |
| 6,502,570 | B2 | * | 1/2003 | Grady | 312/323 X |
| 2002/0113532 | A1 | * | 8/2002 | Hornberger et al. | 312/323 |
| 2003/0117047 | A1 | * | 6/2003 | Heidmann et al. | 312/323 |

* cited by examiner

*Primary Examiner*—Rodney B. White
(74) *Attorney, Agent, or Firm*—Flynn, Thiel, Boutell & Tanis, P.C.

(57) ABSTRACT

A storage cabinet employing a door formed in one monolithic piece from a thin sheet of light-weight but relatively rigid material, such as compressed resin-bonded plastic fibers. The door has a pair of panels, such as upper and lower door panels, integrally joined through a living hinge.

30 Claims, 17 Drawing Sheets

FIG. 15A
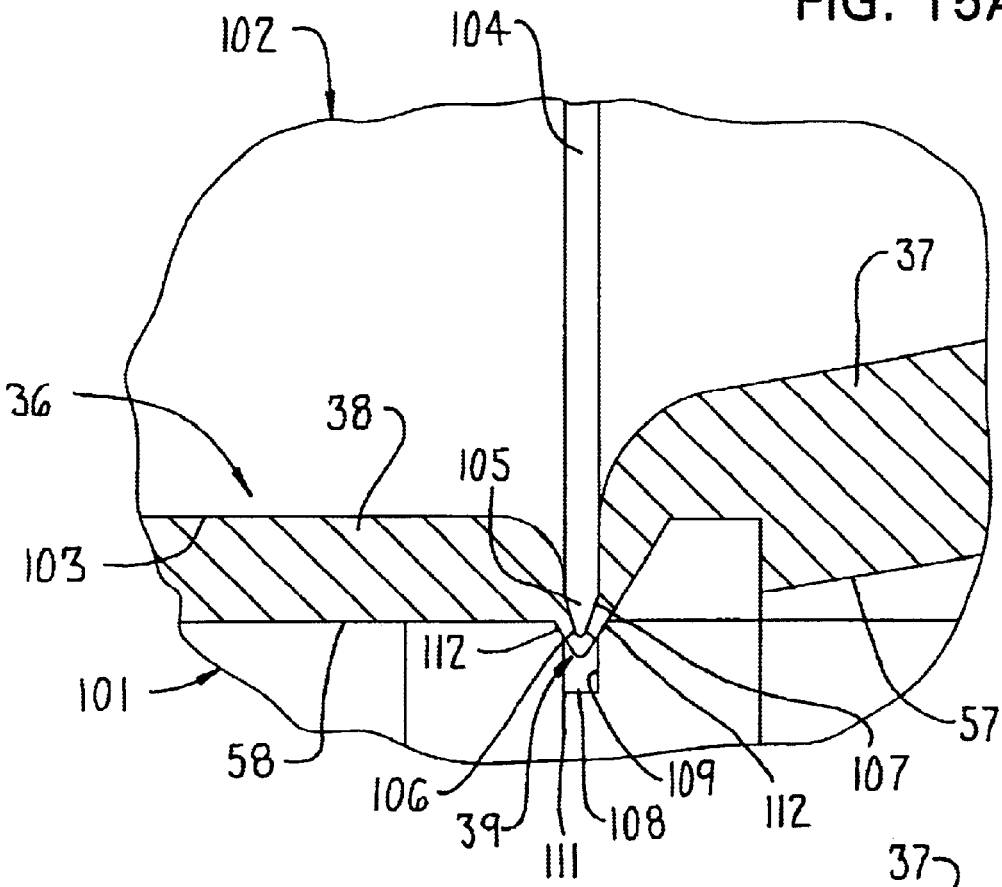
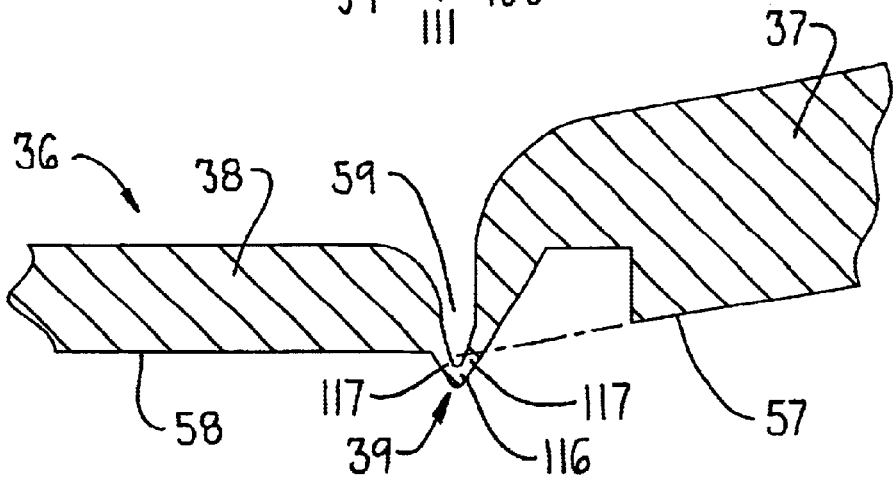
FIG. 15B

STORAGE CABINET WITH MOVABLE DOOR

CROSS-REFERENCE TO RELATED APPLICATION

This application claims priority under 35 USC §119(e) of copending provisional application Ser. No. 60/360,484 filed Feb. 28, 2002, the entire disclosure of which is herein incorporated by reference.

FIELD OF THE INVENTION

This invention relates to an improved light-weight door for use on a storage cabinet. This invention also relates to a storage cabinet of the type used in offices and the like and, more particularly, to an improved storage cabinet intended for mounting in an overhead position relative to a worksurface or the like to provide improved ease of operation with respect to opening and closing of the cabinet and to additionally provide improved flexibility with respect to the appearance and use of the door associated with the cabinet.

BACKGROUND OF THE INVENTION

Overhead cabinets are conventionally and widely used in office environments and the like for storage of papers, books and miscellaneous. Such cabinets are conventionally mounted in an overhead position with respect to a worksurface, such as above a table or desk. In many such situations the cabinet is mounted on a side surface of a wall, such as a portable space-divider panel, and is positioned in upwardly spaced relationship from a worksurface so as to be reasonably accessible, but yet not interfere with use of the worksurface.

Overhead cabinets of the type discussed above have often employed an openable front door which moves with a combined hinging and translating (i.e. sliding) movement whereby the door is initially hinged upwardly into an open position, and then horizontally slidably moved rearwardly into a storage position wherein the door is disposed closely adjacent and positioned either above or below the top wall of the cabinet. Cabinets of this type employing what is oftentimes referred to as a "flipper" door have been extensively utilized for many years, but nevertheless have possessed recognized disadvantages with respect to ease of access and operation. More specifically, while the door oftentimes can be moved into an open position by a person seated adjacent a front of the worksurface, nevertheless closing of the door normally requires that the person stand and grip the front edge of the door and then pull the door outwardly while permitting it to swing downwardly into the closed position. Further, the door is frequently rather heavy, typically being constructed of particle board or metal, and gripping the door so as to move it into the upward open position, and conversely gripping and controlling the downward moving of the door into the closed position, generally requires substantial manual force in order to safely control and effect the opening and closing movements. This also frequently requires gripping of the lower edge of the door with both hands. Performing the door opening and closing function has also been undesirable in that such cannot typically be conveniently accomplished in a seated position. The complex or multiple phases of the door movement, and the significant forces associated therewith as discussed above, significantly increase the difficulty of opening and closing the cabinet door.

In an attempt to improve on cabinets of this general type, some cabinets have been provided with a door which is solely swingable between open and closed positions. In these known cabinets, the door has been provided with end panels or arms which provide a horizontal swinging axis so that the door solely swings between a closed position and a generally overhead open position. Cabinets of this latter type, however, have generally possessed features which have been less than desirable. For example, in some of the cabinets the door has been solely manually swingable in both the opening and closing direction which, coupled with the unbalanced weight of the door, has made the opening and closing movement less than desirable. Other cabinets of this type, in an attempt to improve on the unbalanced door weight, have provided gas springs to assist in overcoming the door weight during opening of the door, but contrarily the gas springs cause the force required for closing the door to be increased. Other cabinets have employed counterweight structures coupled to the door and associated with the cabinet end panels in an attempt to at least partially balance the door weight during the opening and closing swinging movements thereof.

In known storage cabinets of the different types discussed above, substantially all of the cabinets have necessarily required either a complex movement mechanism including gear racks or ball slides for permitting the "flipper" door of the cabinet to undergo the required swinging and translating movement between open and closed positions, or conversely have required additional and more complex structures such as counterbalances and swinging arms when the door is supported for solely swinging movement between the open and closed positions. These latter cabinets employing solely swinging doors have also generally encountered more severe restraints with respect to the configuration of the cabinet. Overall, the known cabinets have hence provided undesired restraints with respect to the structure and complexity of the cabinet, and yet have not succeeded in providing a light-weight but durable door which can be readily and easily manually moved between open and closed positions, while at the same time permitting the cabinet to employ a simple cabinet structure which maximizes the storage capacity thereof and permits the overall cabinet to be manufactured in an efficient and economical manner.

Examples of known overhead storage cabinets are illustrated by U.S. Pat. Nos. 1,115,345, 2,301,856, 2,551,305, 2,590,028, 3,730,378, 4,167,298, 4,371,223, 5,050,944, 5,172,969, 5,409,308, 5,845,980 and 6,227,635.

It is an object of this invention to provide an improved door for a storage cabinet, such as an overhead storage cabinet for use in an office environment, which is believed to significantly improve upon prior cabinets of this general type, and particularly is believed to overcome many of the disadvantages mentioned above.

More specifically, the present invention relates to a storage cabinet employing a door which is formed in one monolithic piece from a thin sheet of light-weight but relatively rigid material, such as compressed resin-bonded plastic fibers, with the door employing a pair of door panels, such as upper and lower door panels integrally joined through a living hinge.

Additionally, the invention relates to an improved overhead storage cabinet wherein the door, as aforesaid, also includes an upper mounting panel which fixes to the cabinet structure and joins through a further living hinge to the upper door panel, whereby the door moves with a compound swinging-translational movement between a closed position wherein the front of the lower panel substantially closes off an open front side of the cabinet structure and a closed position wherein the door is stored in a generally flat condition overhead of the cabinet structure. The relative rigidity but light weight of the door permits ease of operation of the door in both opening and closing directions, and at the same time permits storage of the open door in a generally flat overhead position so as to not interfere with or impair the overall aesthetics of the storage cabinet and of the surrounding environment.

In the storage cabinet of the present invention as aforesaid, in a preferred embodiment of the invention, the upper door panel is generally horizontally oriented so as to overlie the front portion of the cabinet structure when the door is in a closed position, and this upper door panel then hinges upwardly and rearwardly about the second living hinge for disposition in a flat condition generally over the rear portion of the cabinet structure when in the open position. Simultaneous with the above movement, the lower door panel is lifted and pivoted vertically relative to the upper door panel about the first living hinge so as to be moved upwardly and rearwardly for disposition in a generally flat condition overhead of the cabinet structure, whereby the lower door panel in the open position overlies the upper door panel and projects forwardly of the top of the cabinet such that the free edge over the lower door panel projects into a position adjacent the upper front corner of the cabinet so as to permit ease of gripping thereof. When in the open position, the disposition of the door and specifically the lower door panel, coupled with the relatively rigid but light weight of the door, permits the lower door panel to be pulled downwardly upon application of only minimal manual force, which in turn causes the upper door panel to swing upwardly and forwardly carrying with it the lower door panel so that the door moves into its closed position.

The door and its integral and monolithic one-piece construction is preferably provided with rolled edge flanges for reinforcement of the door and positioning abutment with the front edges of the cabinet structure end panels.

The storage cabinet of the present invention, as aforesaid, and specifically the mounting flange associated with the integral one-piece door is preferably formed as a large covering panel which overlies and is fixed relative to a top wall of the cabinet structure which is positioned generally adjacent the rearward half of the cabinet whereby the integral one-piece door member provides a uniform appearance throughout substantially the full extent of the front and upper sides of the cabinet when the door is in the closed position.

In the storage cabinet of the present invention, as aforesaid, the integral and one-piece door member is preferably formed by heating and compressing a mat of plastic fibers intermixed with a binder so that compression of the heated mat within an appropriate mold results in the door member having the desired shape and in particular provides a relatively rigid, strong but lightweight door member having panel sections with small thicknesses. As an example, it is contemplated that the lower door panel may have a thickness of about one-fourth inch but will additionally typically be provided with in-turned reinforcing flanges associated with some of the edges thereof, whereas the upper door panel will preferably be provided with a slightly greater thickness, such as for example three-eighths inch, due to its horizontal orientation when the door is in the closed position. The integral fiber-formed one-piece door and its monolithic construction permits the various door panels to be provided with different thicknesses, including different thicknesses along the edges of the respective panels if desired, and additionally permits living hinges of significantly reduced thickness to be defined widthwise across the door member to hence permit relative hinging movement between the lower and upper door panels about the first living hinge while additionally permitting relative hinging movement between the upper and mounting panels about the second living hinge.

Other objects and purposes of the invention will be apparent to persons familiar with constructions of this general type upon reading the following specification and inspecting the accompanying drawings.

BRIEF DESCRIPTION OF THE DRAWINGS

FIG. 15A is an enlarged, fragmentary sectional view illustrating a preferred arrangement for forming the living hinge which couples the upper and lower door panels of the door.

FIG. 15B illustrates the fragmentary sections of the door panels and their connection by the living hinge formed in the mold shown in FIG. 15A, with the living hinge being shown removed from the mold for clarity of illustration.

Figure 1:
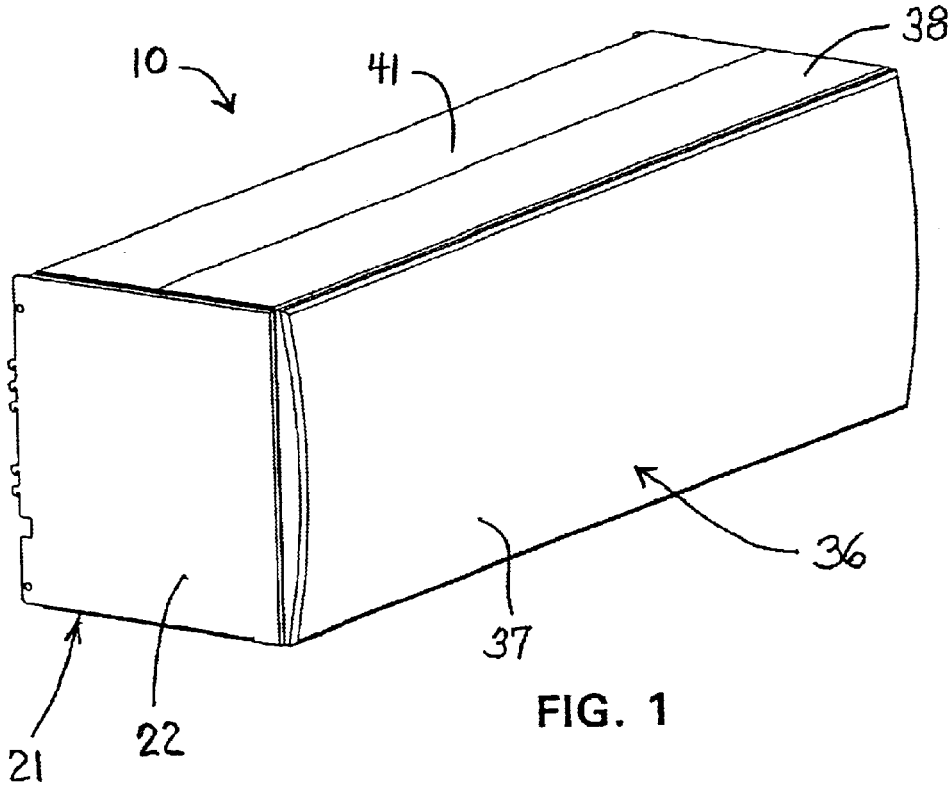
FIG. 1 is a perspective view of a storage cabinet in accordance with the present invention with the door shown in a closed position.

Certain terminology will be used in the following descriptions for convenience in reference only, and will not be limiting. For example, the words "upwardly", "downwardly", "rightwardly" and "leftwardly" will refer to directions in the drawings to which reference is made. The words "upwardly" and "downwardly" will also refer to the normal directions of movement of the door when moving between closed and opened positions. The words "front" and "rear" will refer to those sides of the storage cabinet which are respectively disposed closest to and remote from the user, these respectively being the right and left sides as appearing in FIGS. 7–10. The words "inwardly" and "outwardly" will refer to directions toward and away from, respectively, the geometric center of the cabinet and designated parts thereof. Said terminology will include the words specifically mentioned, derivatives thereof, and words of similar import.

DETAILED DESCRIPTION

Figure 2:
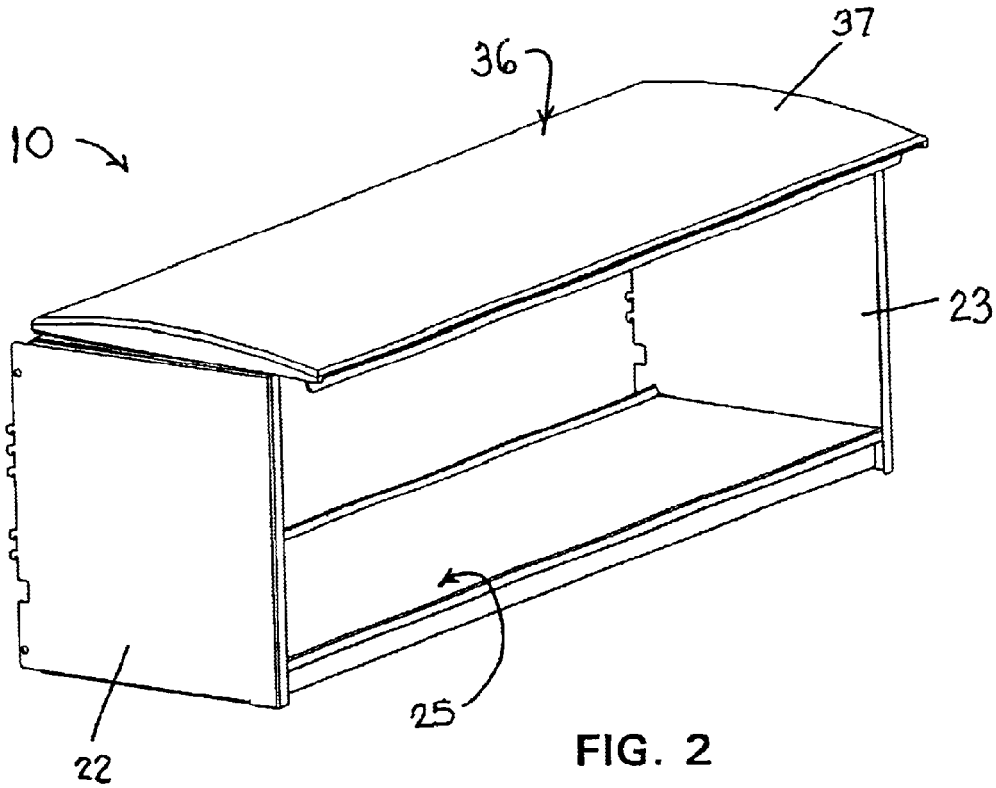
FIG. 2 is a perspective view corresponding to FIG. 1 but showing the door in an open overhead position.
Figure 3:
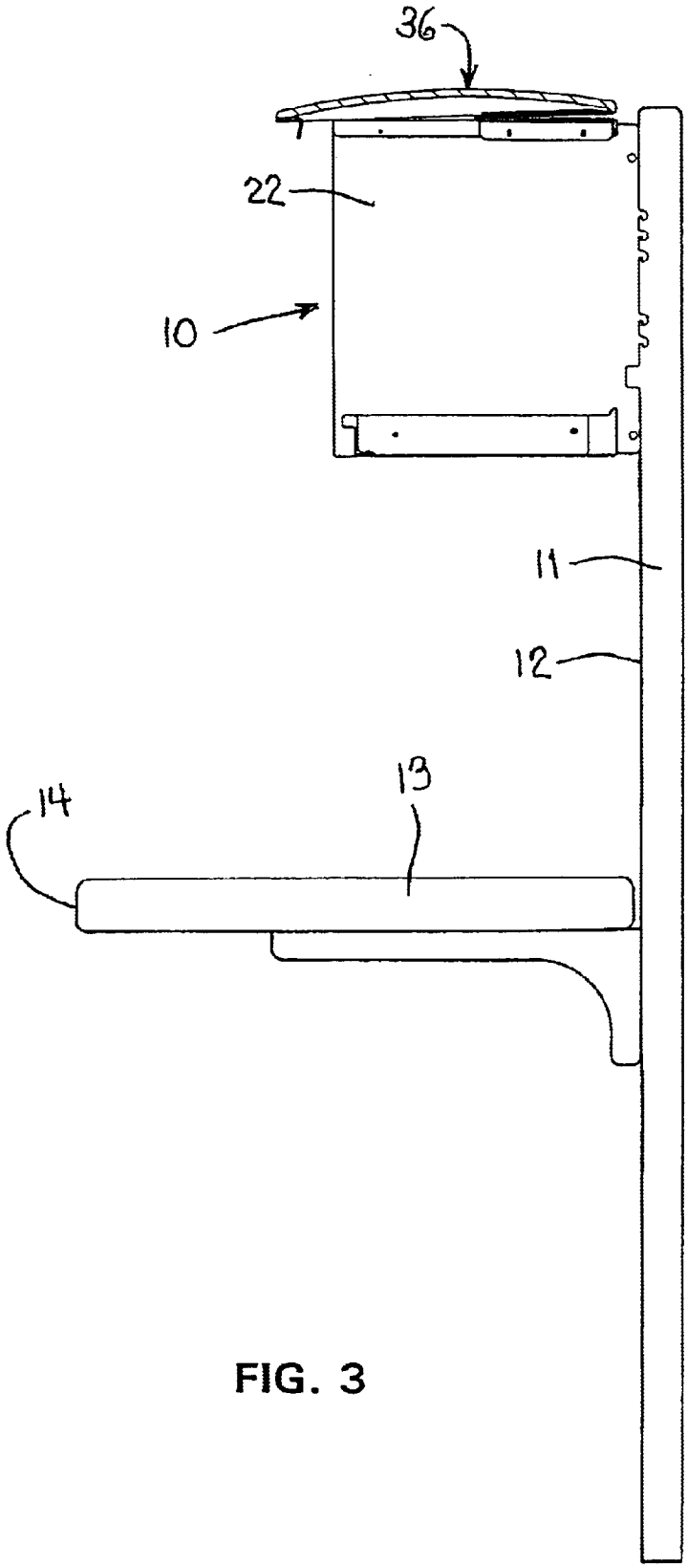
FIG. 3 is a diagrammatic elevational view which illustrates the mounting of the storage cabinet adjacent one side of an upright wall or panel.
Figure 4:
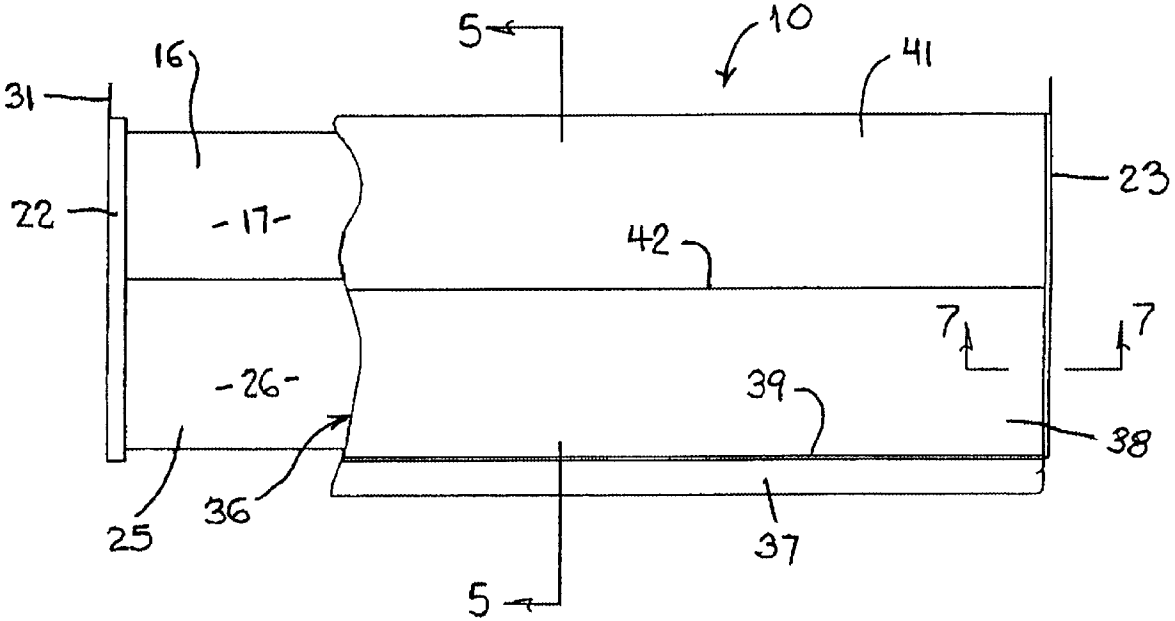
FIG. 4 is a fragmentary plan view showing the top of the storage cabinet when the door is in the closed position.
Figure 7:
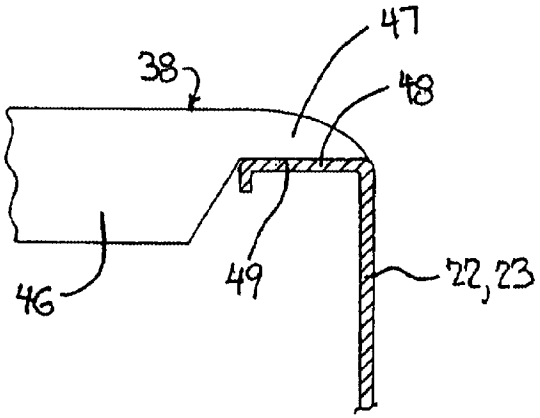
FIG. 7 is an enlarged fragmentary sectional view taken generally along line 7—7 in FIG. 4.
Figure 5:
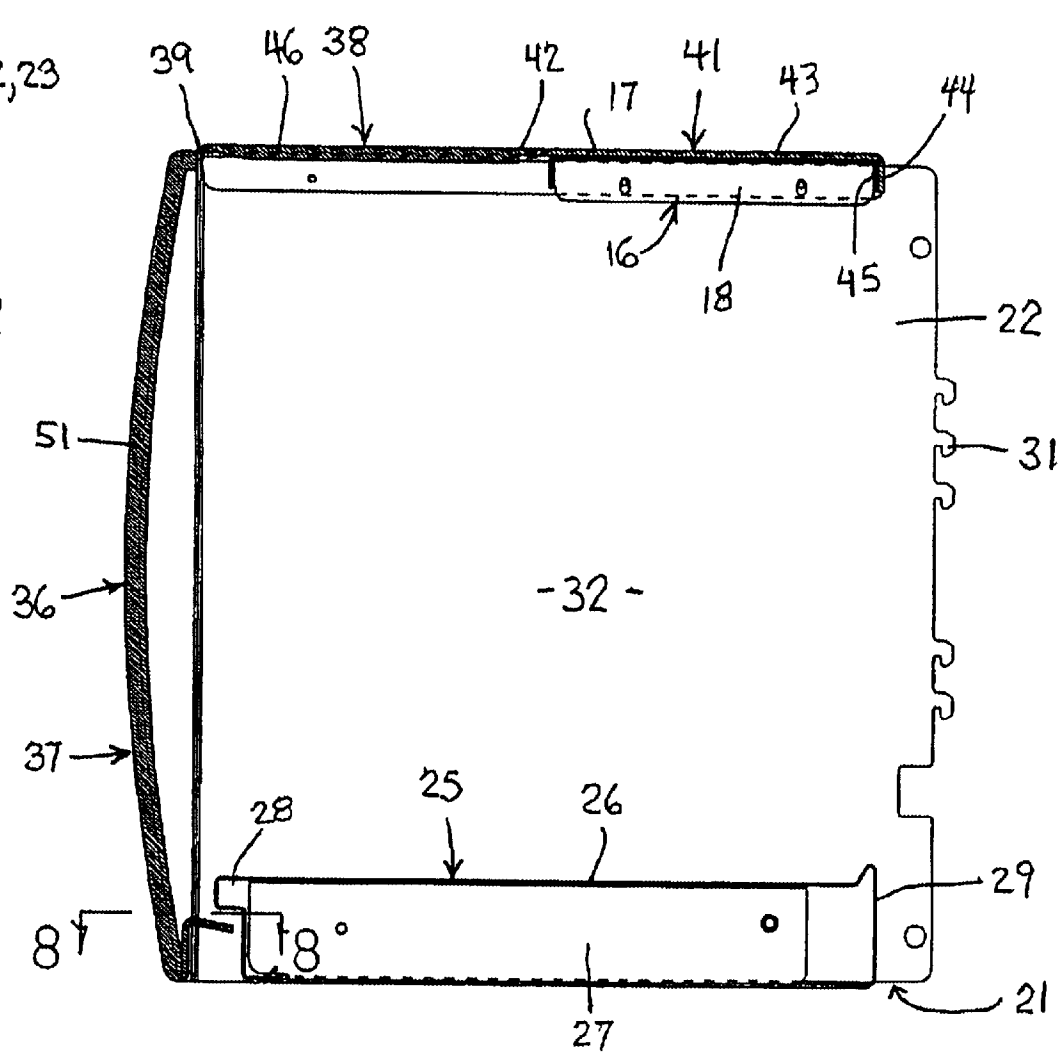
FIG. 5 is a sectional view taken generally along line 5—5 in FIG. 4.
Figure 8:
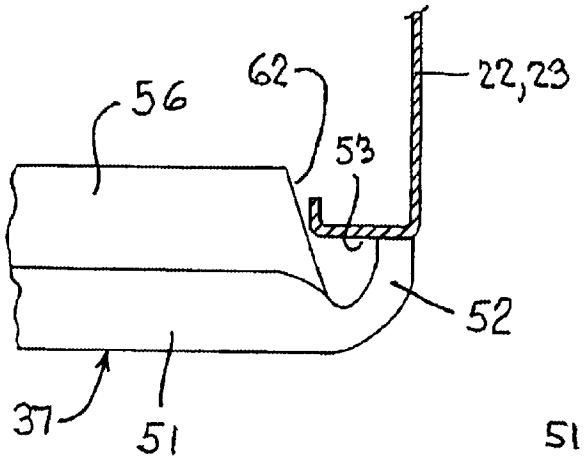
FIG. 8 is an enlarged, fragmentary sectional view taken generally along line 8—8 in FIG. 5.
Figure 6:
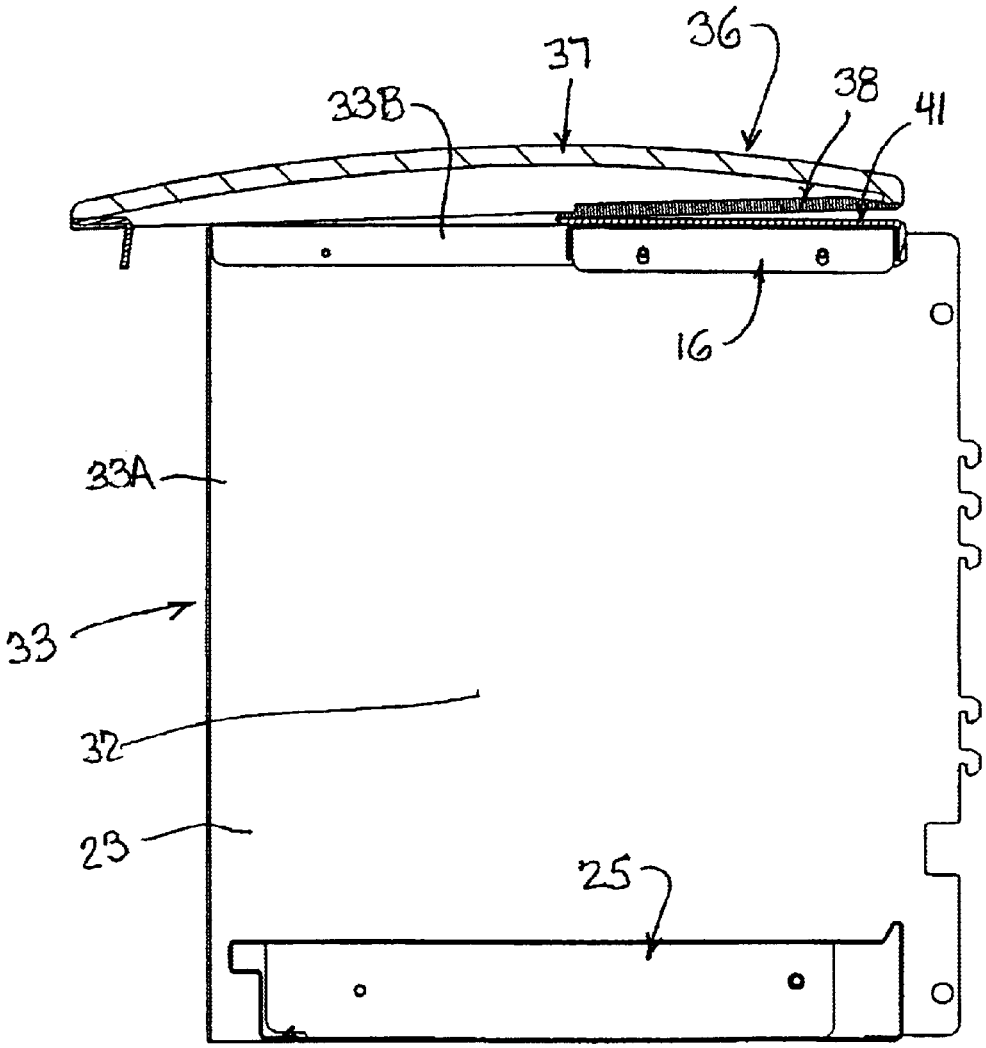
FIG. 6 is a sectional view corresponding FIG. 5 but showing the door in an open overhead position.
Figure 9:
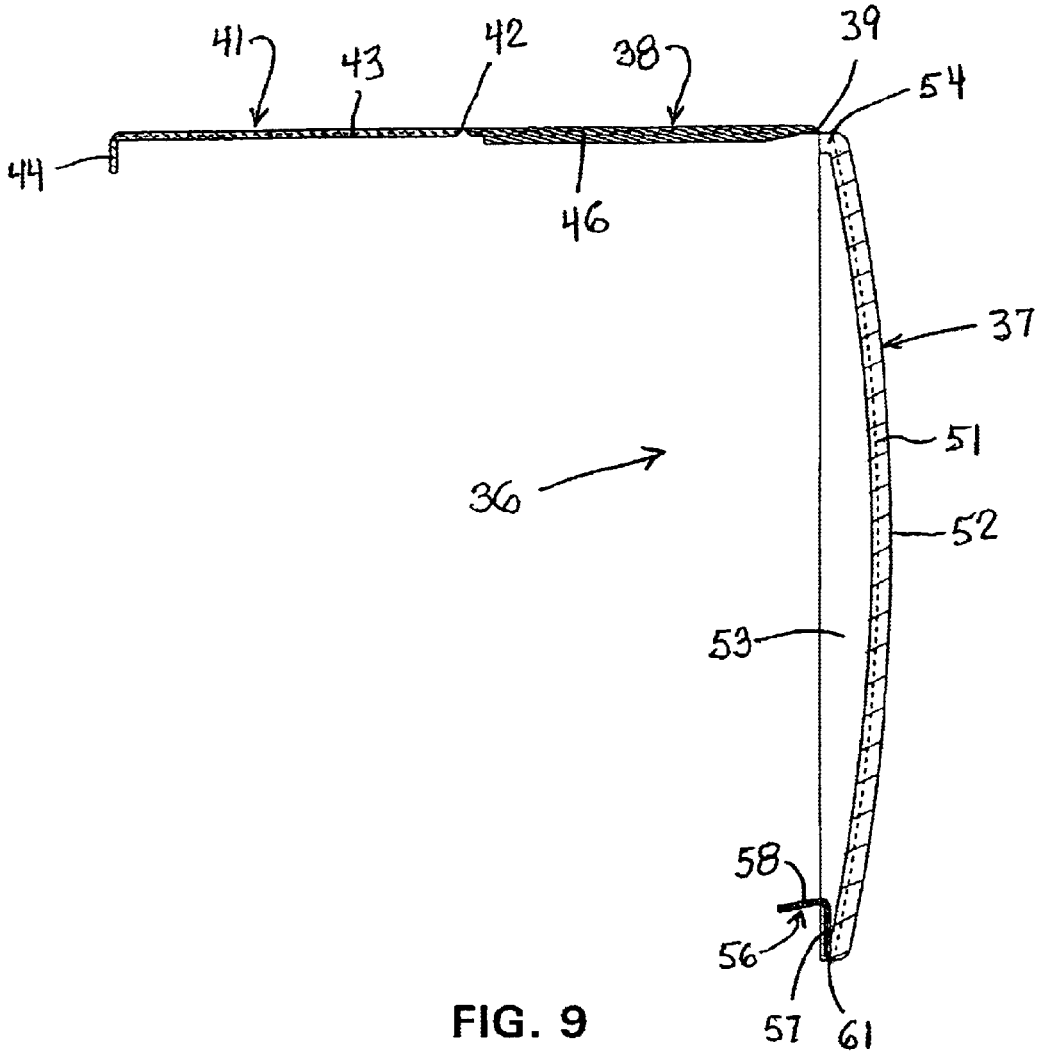
FIG. 9 is a cross-sectional view of the door shown in its closed position but separated from the cabinet.
Figure 10:
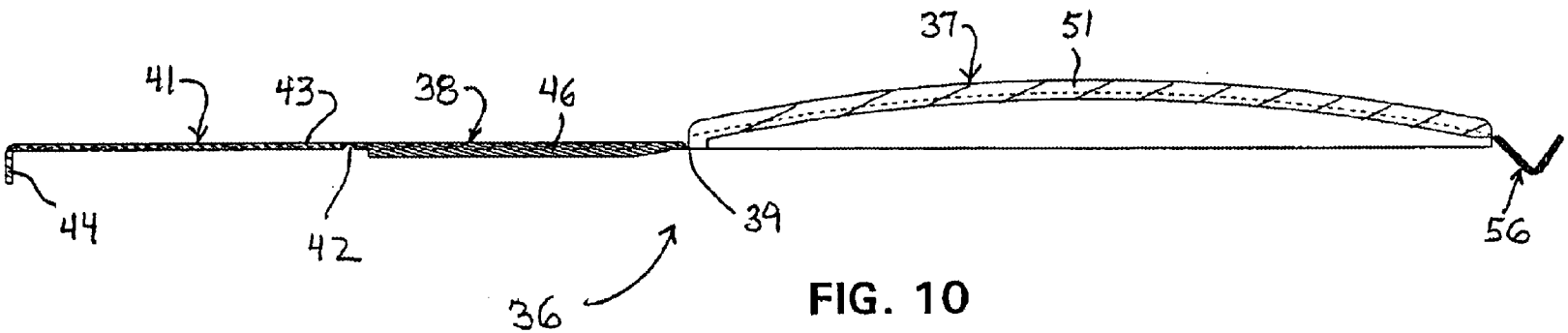
FIG. 10 is a cross-sectional view of the door similar to FIG. 9 but showing the door in a generally flat condition, similar to the expected condition upon removal from the forming mold.
Figure 11:
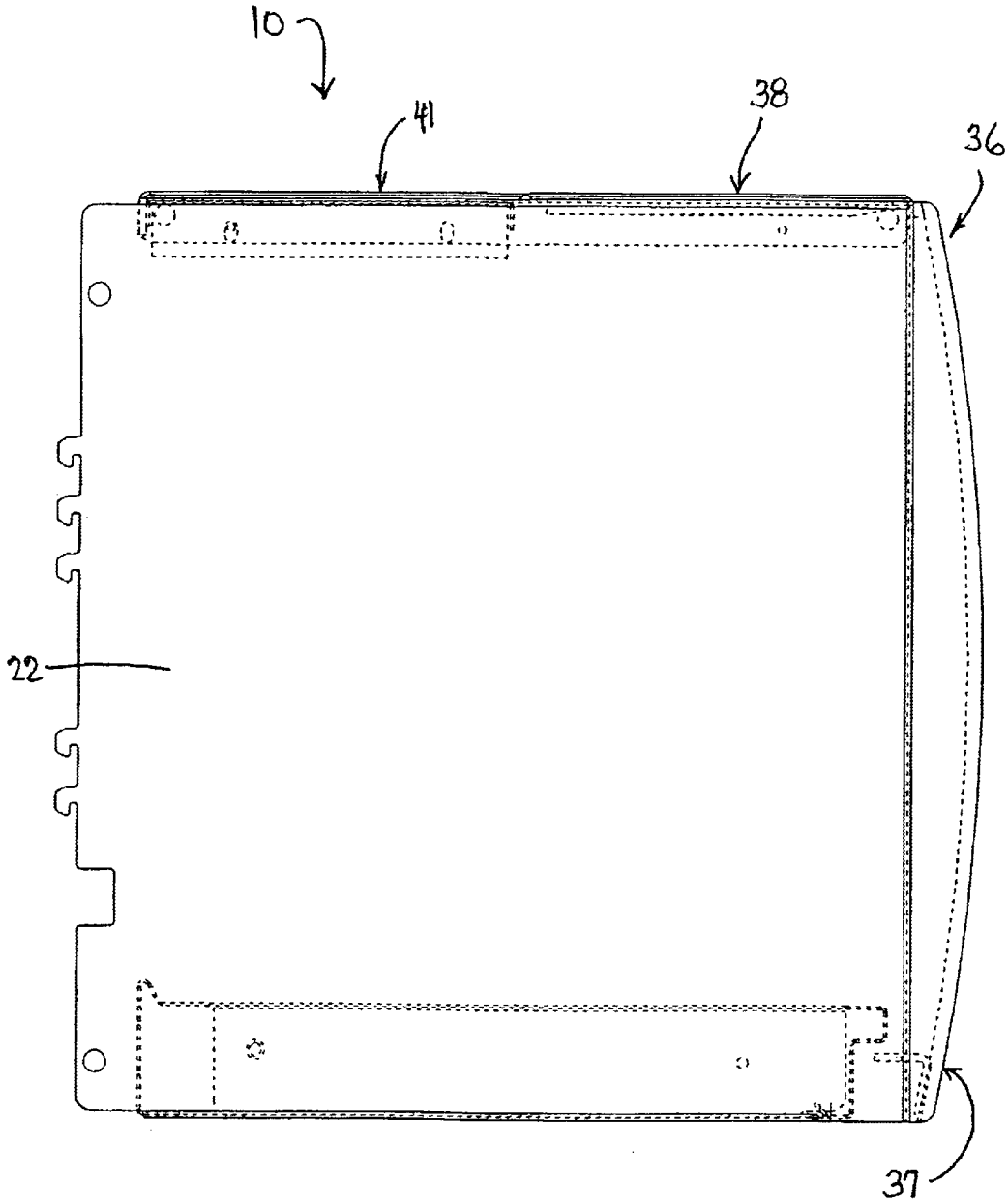
FIG. 11 is an end elevational view of the storage cabinet and showing the door in a closed position.
Figure 12:
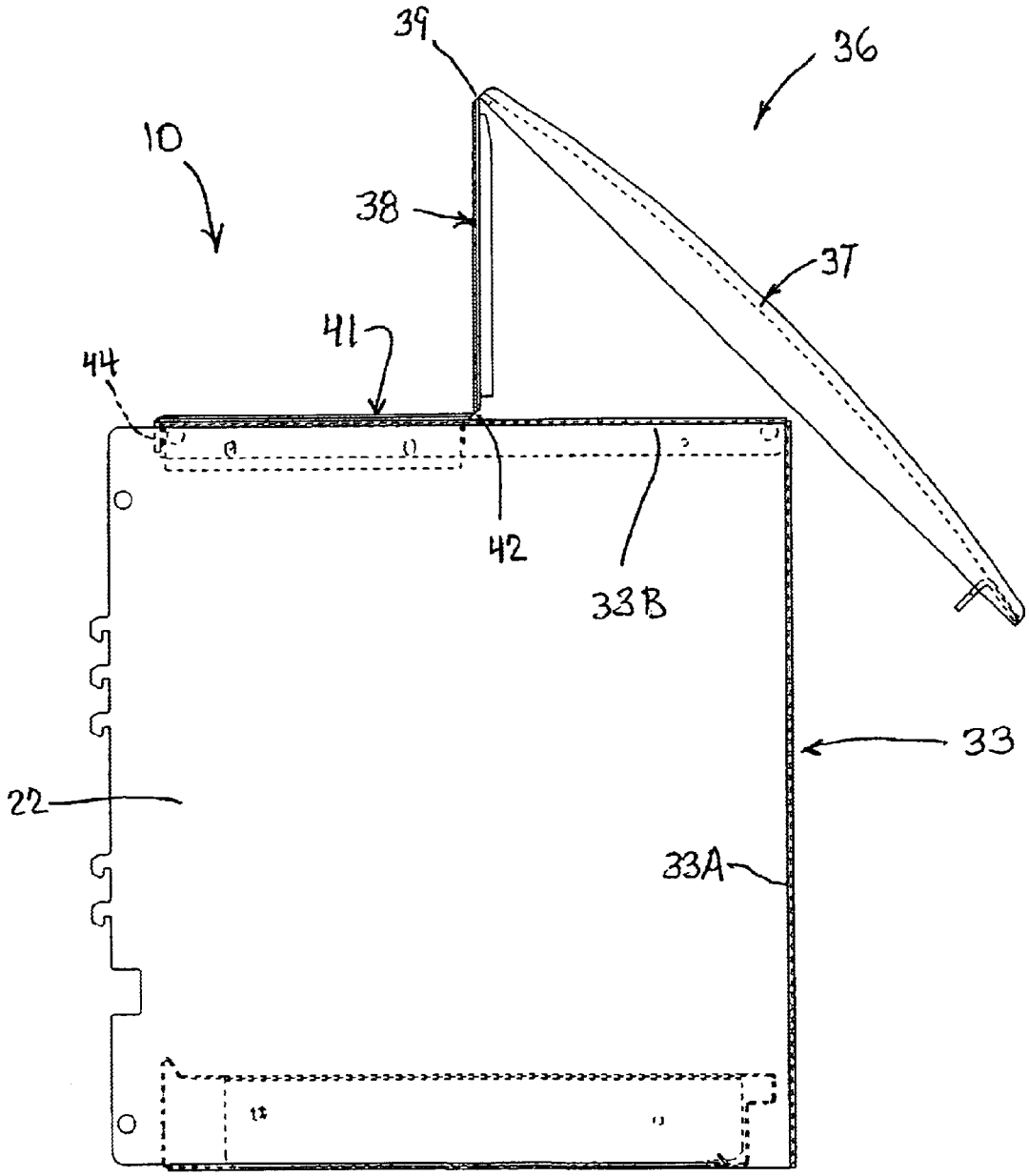
FIG. 12 is a view similar to FIG. 11 but showing the door in a partially opened position.
Figure 13:
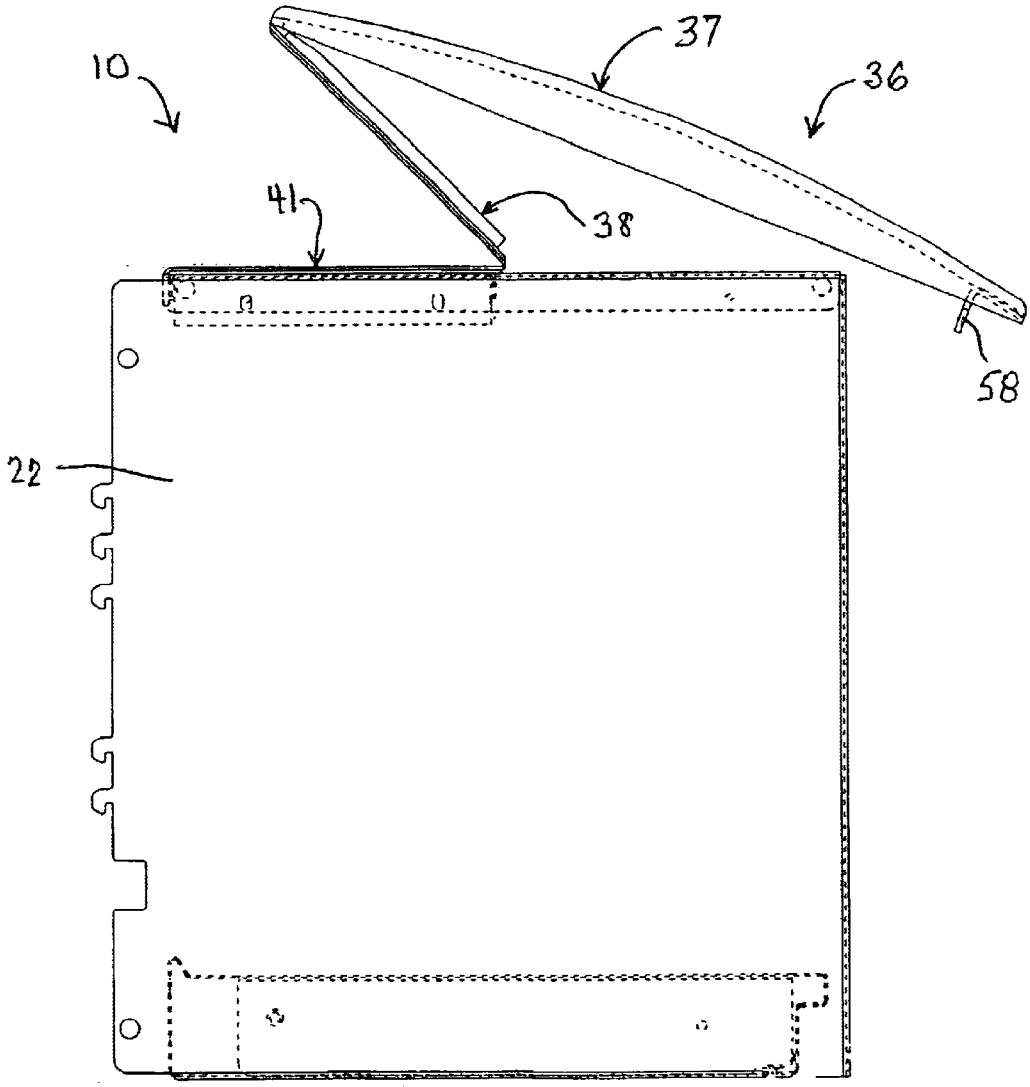
FIG. 13 is a view similar to FIG. 11 but showing the door in a more fully but still partially opened state.
Figure 14:
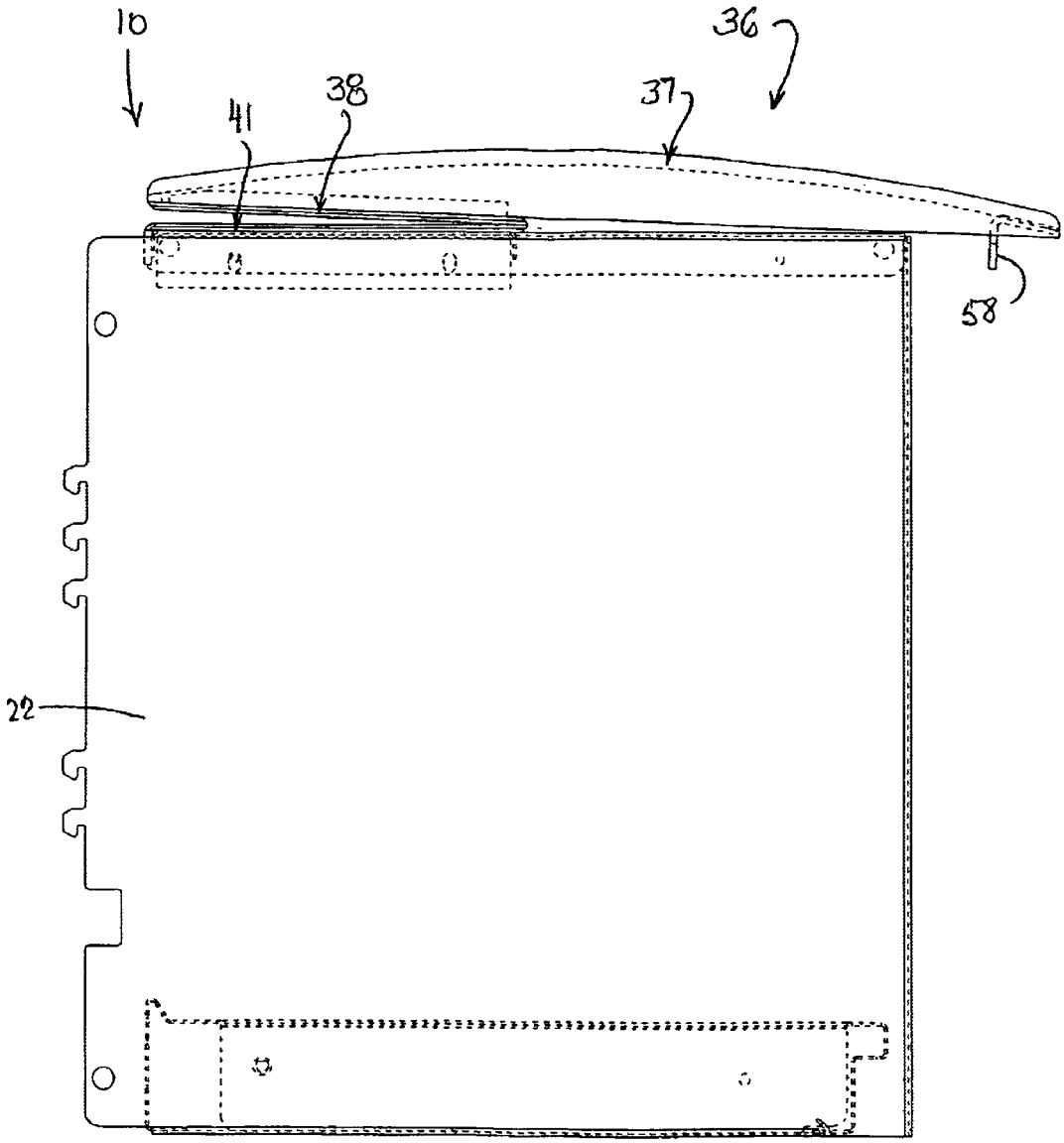
FIG. 14 is a view similar to FIGS. 11–13 but showing the door in its fully opened position wherein the door is stored overhead of the cabinet.

Referring to FIGS. 1–3, there is illustrated a storage cabinet 10, and more particularly an overhead storage cabinet, constructed in accordance with the present invention. The storage cabinet 10 is typically intended for mounting on an upright wall 11, such as a portable space-dividing wall panel, with the cabinet 10 being positioned adjacent one of the vertical surfaces 12 of the wall 11. The cabinet 10, when mounted on space dividing wall panels or walls, is frequently positioned in close proximity to a worksurface 13, such as a table or desk, whereby the storage cabinet 10 is positioned in upwardly spaced relationship above the worksurface 13. The worksurface has a front edge 14 adjacent which a worker normally sits, and the disposition of the cabinet 10 is preferably such that the worker, when seated adjacent the front edge 14, can access the cabinet 10. The cabinet 10 is typically provided with securing structure such as hooks or the like which enable the cabinet to be fixedly but releasably mounted on and cantilevered forwardly from the side surface of the wall 11. Such mounting is conventional and well known.

The cabinet 10 includes a generally rigid housing or body 21 defined by a pair of generally parallel and laterally spaced end panels or walls 22 and 23 which are disposed in an upright, and normally vertical, orientation. These end panels 22 and 23 in turn are rigidly joined together, adjacent lower edges thereof, by a bottom wall or shelf 25 which extends therebetween. The shelf 25 has a generally horizontally planar upper surface 26 which functions as a support surface for objects or articles stored within the cabinet. The bottom wall or shelf 25, adjacent opposite ends thereof, also has downwardly-turned end flanges 27 which overlap and are fixedly secured to the inner surfaces of the end panels 22–23 to create a fixed securement of the end panels and bottom wall. The bottom wall also has front and rear downwardly-turned edge flanges 28 and 29 respectively which extend lengthwise along the edges of the shelf and hence provide substantial vertical strengthening of the shelf.

The end panels 22–23 and the rigid joining thereof by the bottom shelf 25 hence causes the cabinet housing 21 to have a generally upwardly-opening U-shaped configuration.

If desired, however, such as for either strength and/or aesthetic purposes, the cabinet housing 21 can also be provided with a top wall member 16 rigidly joined between the end panels 22–23. The top wall member 16 includes a main and generally horizontally oriented top wall 17 which is spaced upwardly and extends generally parallel with the bottom shelf surface 26. The top wall member 16, in the illustrated embodiment, is preferably provided with downwardly turned edge flanges 18 which overlap inner surfaces of the end panels 22–23 adjacent the upper edges thereof, with these flanges 18 being suitably rigidly joined to the end panels. In this construction, the rigid construction defined by the end panels 22–23 and their joinder by the bottom and top wall members 25 and 16 causes the cabinet housing 21 to have a generally hollow rectangular configuration when viewed horizontally.

In the illustrated embodiment, it will be noted that the top wall 17 has a width which is significantly narrower than the width of the cabinet and the width of the bottom support surface 26, and more specifically the top wall 17 is positioned so that it is disposed generally above about only the rearward half of the cabinet housing 21.

The end panels 22–23 are frequently provided with mounting hardware, such as hooks 31 or similar constructions, projecting rearwardly from the rear edges thereof for permitting the storage cabinet to be releasably mounted on an upright wall. Other types of mounting hardware, and other positioning of the hardware on the overall cabinet, is well known and use of other hardware for mounting the cabinet is within the scope of the present invention.

The cabinet housing 21 as briefly described above defines therein an interior storage compartment 32 which is accessible through an opening 33 defined on the front side of the housing. The opening 33 in the cabinet 10 is generally L-shaped in cross section and includes a main or lower opening portion 33A which extends vertically throughout substantially the full front side of the housing, that is, from the lower shelf 25 up to the upper edges of the end panels. The opening 33 also includes an upper opening portion 33B which is in open communication with the lower opening portion 33A and extends rearwardly from the upper front corner of the housing rearwardly along the upper surface thereof, with this upper opening portion 33B terminating generally adjacent the front edge of the top wall 16. The opening 33, as defined by opening portions 33A and 33B, extends horizontally throughout the full length of the cabinet, namely throughout the full horizontal length between the end panels 22–23.

The storage cabinet 10 is provided with a movable door assembly 36 for permitting opening and closing of the access opening 33. The door assembly 36 comprises a one-piece monolithic door member which, as described below, includes plural hingedly-joined panels so that the door member, in the illustrated embodiment of the invention, can be readily manually moved between a closed position wherein it totally closes off the L-shaped opening 33, and an open position wherein the door member is stored in a generally folded but flat condition above the housing to hence uncover and provide access to the interior of the storage cabinet through the front access opening portion 33A.

More specifically, and as illustrated by FIGS. 1–10, the monolithic one-piece door member 36 includes a lower door panel 37 which effectively closes off the upright opening portion 33A when the door is in a closed position, and also includes an upper door panel 38 which extends generally horizontally and overlies and thus closes off the upper opening portion 33B when the door is in the closed position. The door panels 37 and 38 are integrally and monolithically joined together by a living hinge 39 which is horizontally elongated across the width of the door member, and which when the door is in the closed position is disposed adjacent the front upper corner of the storage cabinet.

The monolithic one-piece door member 36 also includes a mounting flange or panel 41 which is monolithically and integrally joined to the other edge of the top panel 38 through a second living hinge 42 which extends horizontally across the width of the door member in generally parallel relationship to the first living hinge 39.

The mounting panel 41, in the illustrated embodiment, includes a covering panel 43 which is joined to and extends rearwardly from the living hinge 42, with the covering panel being sized to substantially coextensively overlie and hence cover the upper surface of the top wall 16. The covering panel 43, at its rear edge, is joined to an edge flange 44 which protrudes downwardly and overlaps the rear edge flange of the top wall 16. The mounting panel 41 is suitably fixed to the top wall 16, which securement may take many different forms. For example, the edge flange 44 can be secured to the rear flange 45 of the top wall member 16 in any conventional manner, such as by rivets or threaded fasteners. Alternatively, or in addition, the covering panel 43 can be fixed directly to the top wall 17, such as by fasteners or by means of a suitable adhesive, such as a hot melt.

Considering now the constructional details of the monolithic one-piece door member 36, the top door panel 38 includes a main center panel part 46 which is of greater thickness and extends transversely between the living hinges 39 and 42 and lengthwise throughout the length of the cabinet as defined between the end panels 22–23. This top panel 38, adjacent opposite ends of the main center panel part 46, is additionally provided with outwardly projecting edge flanges 47 (FIG. 7) which project outwardly through a small extent so as to overlie the upper edge surfaces 48 of the end panels 22–23. The edge flanges 47 have a thickness less than the center panel part 46 and hence define recesses 49 on the underside thereof which accommodate therein the upper edges of the end panels 22–23 when the door member 36 is in the closed position. The edge flanges 47 extend transversely, i.e. perpendicularly, across a majority of the width of the panel 38 as defined between the living hinges 39 and 42.

The front or lower panel 37 is defined principally by a main center panel part 51, the latter having an outer surface 52 which effectively defines the exposed or visible surface of the door panel 37 when the door 36 is in the closed position. The main panel part 51 will typically be of generally uniform thickness throughout, although the thickness of the door panel part 51 will generally be significantly less than the thickness of the upper panel part 46 since the front panel 37 is generally vertically oriented in the closed position and hence is not subjected to the same bowing loads as encountered by the top panel 38. The front panel part 51 can also be provided with either a flat or curved configuration, and in the illustrated and preferred embodiment has an outwardly bowed or arcuate configuration when viewed in vertical cross section.

The overall strength and appearance of the front door panel 37 is further enhanced by means of an edge flange construction which extends generally around and projects rearwardly with respect to the main center panel part 51. This edge construction includes inwardly turned side edge flanges 52 (FIG. 8) which extend vertically along opposite sides of the main panel part 51 and which project transversely inwardly therefrom through a short extent. These side edge flanges 52 are generally aligned with and adapted to substantially abut the flat front upright surfaces 53 defined on the end panels 22–23 when the door is in the closed position.

The edge flange associated with the door panel 37 also preferably includes a top edge flange 54 which extends horizontally along and projects transversely rearwardly relatively to the main center panel part 51. This top edge flange 54, at opposite ends thereof, joins to the side edge flanges 52 at the door panel corners. Top edge flange 54 also effectively joins to and extends along the living hinge 39.

The surrounding edge flange construction associated with the front door panel 37 also includes a closure flange 56 which extends lengthwise along the door panel 37 adjacent the lower edge thereof. This closure flange 56 is of a generally L-shaped cross section and includes an upright leg 57 which at its upper end is integrally and monolithically joined to an inwardly protruding leg or flange 58, the latter terminating at a free edge or end 59.

The L-shaped closure flange 56 is integrally and monolithically joined to the panel 37 and, for this purpose, the lower end of the upright leg 57 is joined to the lower edge of the panel 37 through a third living hinge 61 which extends generally throughout the length of the door and extends in generally parallel relationship to the first hinge 39. The closure flange 56 is bent inwardly and upwardly about this hinge 61 so that the upright leg 57 overlies the inner surface of the panel 37 adjacent the lower edge thereof, and the upright leg 57 is then suitably secured in this latter overlapping position, such as by means of an adhesive or hot melt. With the closure flange in this secured position, the upper leg 58 thereof projects rearwardly and generally inwardly toward the bottom shelf of the cabinet when the door is in the closed position, and this flange 56 hence can function as a stop for defining the closed door position if desired. More significantly, however, the opposite lengthwise ends of the flange 56 are provided with sloped or tapered surfaces 62 (FIG. 8) thereon. These tapered surfaces 62, which converge inwardly toward one another as they project rearwardly, are positioned in closely adjacent relationship to the inner edges of the end panels 22–23 when the door is in or adjacent the closed position, whereby these surfaces 62 effectively function as wedge-like surfaces to thus engage the respective side panels and effect sideward repositioning of the door to hence ensure that the door is properly aligned with the cabinet when in the closed position.

As regards the mounting panel 41, and specifically the covering panel 43, the latter will typically have a substantially uniform thickness therethrough, which thickness will typically be significantly less than the thickness of the main pad part 46 associated with the top panel 38. The thickness of the main covering panel 43 will also generally be no greater than, and typically somewhat less than, the thickness of the main front door panel 51.

The one-piece monolithic door member 36 of the present invention is preferably formed, in its entirety, of a compressed, for example, molded fibrous material wherein the fibers are intermixed with a suitable binder such that the material can be appropriately configured so as to have different shapes and thicknesses to hence define the entire door member as a monolithic one-piece construction while at the same time enabling different portions of the door member to not only have different shapes and thicknesses, but to additionally permit the different portions to be defined by thin but pliable living hinges which are defined by the same compressed fibrous material. The material for the one-piece door member, in a preferred embodiment, comprises plastic fibers and more specifically recycled polyester (PET) fibers with a resin binder such as a polypropylene binder. The resin binder of the material will preferably have a melting temperature slightly below the melting temperature of the plastic fibers so that, during heating and subsequent compression, the melting of the binder and the compression of the mat will cause the fibers to be securely joined together without effecting any significant melting of the fibers. With this material, the PET fiber/resin mixture is initially formed into a mat which is typically of generally uniform thickness, and which for example may be about one and one-fourth inch in thickness. This fiber mat is then heated and, in the heated state, subjected to compression within a mold having the desired shape, such as a shape corresponding to the overall door member 36. The mold hence effects reshaping and compression of the heated mat so that the fiber/binder mixture is both compressed and shaped in accordance with the mold profile so that the different shapes and thicknesses of the door are hence created in the mat. This compression and heating of the mat shapes it into the door member, and the subsequent cooling of the shaped door member causes it to assume a more rigid configuration and hence retain its molded shape. The door member as molded, however, still retains sufficient resiliency due to the compressed thinness at the living hinges so as to permit appropriate flexing of the panel parts which adjoin the living hinges to permit the door member, when mounted on the cabinet housing, to undergo the requisite movements.

While the mat used for forming the door may be of a single layer having the same fibers and binder throughout the thickness thereof, it will be appreciated that the mat may also be defined by two or more superimposed layers so that the individual layers may be provided with different types, sizes or colors of fibers as well as different binders so as to provide optimization with respect to the desired properties of the molded door. For example, use of two superimposed layers for defining the mat may permit the texture or density of the door and specifically the layers which define the exterior and interior surfaces of the door to have different densities or textures or colors.

In the illustrated and preferred embodiment, the monolithic door member as formed from heating and compressing a mat formed from a PET fiber/binder mixture results in the door member having various thicknesses associated with the different main panel parts so as to optimize the overall properties of the door member. For example, the main front panel part 51 will typically have a thickness of about one-fourth inch, whereas the main top center panel part 46 will have a thickness of about three-eighths inch so as to have greater strength to resist horizontal bowing due to the manner in which it horizontally spans the open top of the cabinet housing. The living hinges, on the other hand, will generally be of minimal thickness, as discussed below, so as to provide the requisite degree of pivoting movement required for proper door operation. Such living hinges as defined by the compressed and molded door member are nevertheless believed to provide not only a door member which will be freely swingable during its opening and closing movements, but which will possess the requisite durability to permit a large number of door movement cycles to occur so as to provide a long door life.

The compressed fibrous material of the door, in addition to its light weight and hence the desirable ease of manual manipulation permitted thereby, also enables the door front to function effectively as a tack board in that the porosity of the door material and the nature of the material is such that pins and tacks can be easily inserted into and retained by the material so that notes and the like can be easily pinned thereon for ready visibility and accessibility by the adjacent worker.

Figure 15:
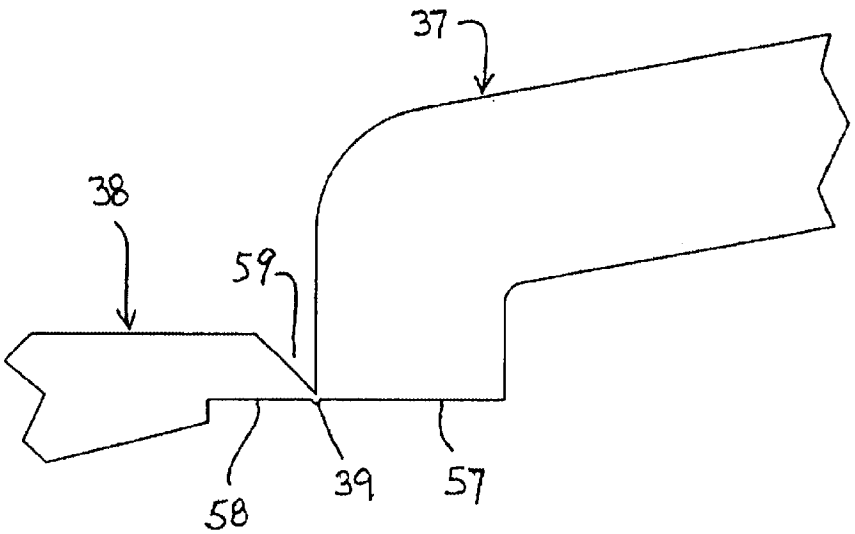
FIG. 15 is an enlarged fragmentary sectional view showing the living hinge which couples the upper and lower door panels of the door.
Figure 16:
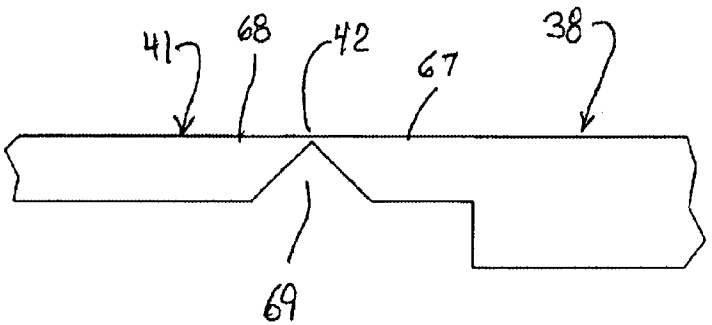
FIG. 16 is an enlarged fragmentary sectional view showing the living hinge which couples the upper door panel and the mounting panel.
Figure 17:
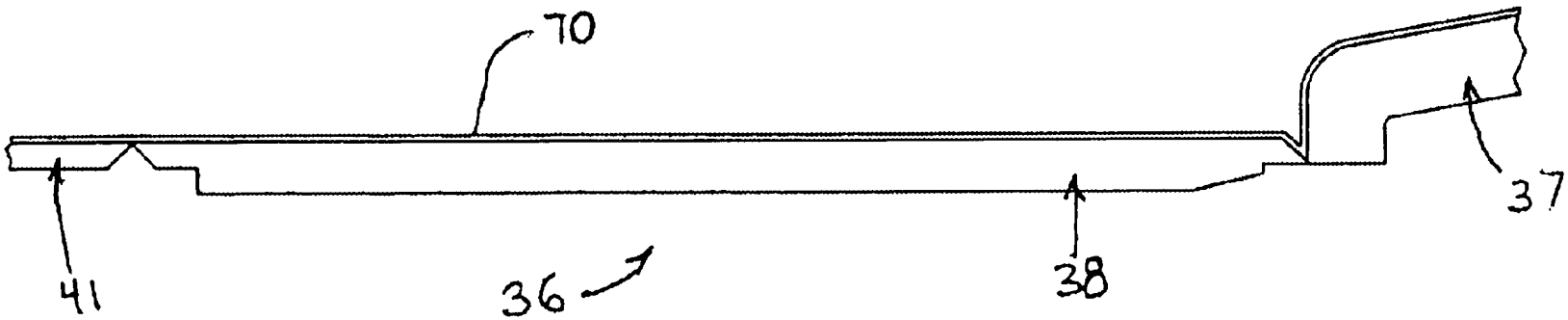
FIG. 17 is an enlarged fragmentary sectional view similar to FIGS. 15–16 but which illustrates a variation of the invention wherein the door is provided with a thin flexible covering adhered to the underlying compressed fibrous mat and covering the exterior surfaces thereof.

Referring now to FIGS. 15 and 16, there are illustrated cross-sectional views of preferred constructions for the living hinges associated with the compressed light-weight fibrous door of the present invention. The hinges are depicted in FIGS. 15 and 16 in a generally flat or straight condition (which condition will typically exist during the molding of the door) so as to facilitate description of the features associated with the hinge.

Considering initially the living hinge 39 which joins the upper and lower door panels 38 and 37 respectively, this hinge 39 as shown in FIG. 15 has, following compression of the mat within the mold, a thickness which is very thin in relationship to the finished thickness of the door as defined by the adjacent door panels 37 and 38. The thickness of the living hinge 39 must be sufficient to permit repeated hinging of the lower door panel 37 relative to the upper door panel 38, but at the same time must be of sufficient thinness so as to permit relative hinging to occur freely and without requiring significant external force to effect the desired hinging movement. In this respect, it has been experimentally observed that the living hinge 38, when formed from a fibrous mat of the type described above, should have a thickness in the range of about 0.020 inch to about 0.035 inch, with the thickness of the living hinge more optimally being in the range of from about 0.025 inch to about 0.030 inch. The hinge will also typically have a transverse width, that is the width of the hinge as it joins the adjacent door panels 37 and 38, which will be of similar magnitude to its thickness.

The living hinge 39 which connects the lower door panel 37 to the upper door panel 38 is, as shown in FIG. 15, preferably disposed so that it is approximately coplanar with or even slightly below the lower plane of the molded door as defined by the bottom surfaces 57 and 58 on the adjacent door panels 37 and 38 where they adjoin the hinge 39. In addition, the forming (i.e. compressing and molding) of the door and specifically the molding of the living hinge 39 is caused by forming a V-shaped groove 59 which opens inwardly from the opposite or outer surface of the door member when in the flat condition, which V-shaped groove 59 extends through substantially the entire thickness of the door member except for the thin living hinge 39 which is defined at the lower apex of the V-shaped groove 59. This V-shaped groove 59, during forming of the door in the generally flat condition, is relatively narrow in that the V-shaped groove defines a small included angle at the apex thereof. This configuration hence enables the door panels 37 and 38 to be relatively hingedly swingably moved about the living hinge 39 downwardly in FIG. 15 toward one another through a hinging angle in the neighborhood of 180° which is equivalent to the movement of the door when it moves between the closed and open positions illustrated by FIGS. 4 and 5. The living hinge 42 which joins the upper door panel 38 to the mounting panel 41 is, as illustrated in FIG. 16, similarly constructed except that the living hinge 42 is disposed substantially coplanar with or slightly above the adjacent upper surfaces 67 and 68 which define the adjacent interconnected portions of the panels 38 and 41. The living hinge 42 will have a thickness similar to the hinge 39 described above, and is also defined at the apex of an inverted V-shaped groove 69 which opens upwardly from the bottom side of the door member and which projects through substantially the entire thickness of the door member except for the presence of the thin living hinge 42. The V-shaped forming groove 69, however, when the panels 38 and 41 are in a generally flat and coplanar relationship, is formed with a significantly wider groove width or included angle, which groove as illustrated in FIG. 16 may define therein an included angle in the neighborhood of about 90°. The living hinge 42 again permits relative upward hinging between the panels 38 and 41 through an angle of at least about 180° so that the upper door panel 38 can hence be hingedly moved with respect to the mounting panel 41 between the closed and open positions illustrated by FIGS. 4 and 5.

Referring now to FIGS. 15A and 15B, there is illustrated a preferred construction and forming process of the living hinge 39 which couples the front door panel 37 to the top door panel 38.

As briefly discussed above, the door member 36 is preferably formed by positioning a fibrous mat in a mold, such as a mold cavity 103 defined between lower and upper mold members 101 and 102 respectively, and then closing the mold to define the cavity 103 and thereby permit compressing of the fibrous mat to define the finished configuration of the door member 36. The forming of the mat within the mold to define the door member occurs generally with the door member in a substantially flat condition, as diagrammatically illustrated by the closure of the mold and the cooperation thereof with the door panels 37 and 38 in FIG. 15A.

To permit forming of the living hinge 39, the upper mold part 102 has a forming blade 104 fixed thereto and projecting downwardly into the mold cavity. This forming blade 104 has a tapered tip 105 which terminates in a rounded end or nose 106 at the lower free end thereof. The tip 105 has sloped side walls 107 which converge as they project downwardly for merger with the rounded nose 106.

The nose 106 associated with the blade 104 is generally aligned with and projects partially into an elongate groove or recess 108 which is formed in and opens upwardly through the upper surface of the lower mold part 101 when the mold parts 101 and 102 are in a closed engaged relationship as illustrated in FIG. 15A. The recess or groove 108 is defined between generally parallel side walls 109 which terminate at a bottom wall 111. The side walls 109 join to sloped side walls 112 which slope or flare outwardly in diverging relationship as they project upwardly for communication with the upper surface of the lower mold part 101 and hence for communication with the mold cavity 103.

When the upper mold part 102 is relatively moved into a closed position with the lower mold part 101 as illustrated in FIG. 15A, these mold parts not only effect shaping of the fibrous mat so as to define the desired shape of the door member substantially as illustrated by the door panels 36 and 37, but the lower end of the blade 104 is moved downwardly into the mat so as to deflect the adjacent region of the mat downwardly so that the living hinge 39 is formed. The latter includes an arcuate hinge portion 116 which wraps around the exterior convex configuration of the nose 106, and this arcuate portion 116 in turn joins to a pair of hinge leg parts 117 which project upwardly for merger with the respective door panels 36 and 37. The hinge leg parts 117 are effectively formed by being compressed between the blade side walls 107 and the respectively opposed sloped side walls 112 which define the mouth of the groove 108. The opposed side walls 107 and 112 slope at different angles so as to slightly converge as they project downwardly toward the recess 108, thereby providing a progressive compression of the fibrous material defining the hinged leg parts 117 as the upper mold 102 and the blade 104 carried thereon is moved into its closed position. With the upper mold part 102 in the closed position as illustrated, the nose 106 of the blade 104 projects downwardly partially into the recess 108 through a small vertical extent, such as into the flared mouth of the recess as defined by the sloped side walls 112, and at the same time the arcuate portion 116 of the living hinge wraps around the nose but this arcuate portion 116 is disposed generally within the width of the recess 108 and is spaced upwardly from the bottom wall 111 thereof. The lower or exterior convex surface of the arcuate hinge portion 116 thus is not subjected to direct confinement or compression thereagainst, whereby the arcuate hinge portion 116 hence is subjected to less compression and accordingly retains a higher degree of flexibility so that this arcuate hinge portion 116 is capable of permitting significant relative pivoting movement between the door panels 37 and 38 over a substantially large number of cycles. Since the arcuate hinge portion 116 is effectively disposed below the bottom surfaces 57–58 defined on the respective door panels 37–38, the center point for this arcuate hinge portion 116 is disposed more closely adjacent the planes defined by the bottom surfaces 57–58 and hence provides the desired hinging of the front door panel 37 relative to the upper door panel 38.

It will be understood that the blade 104 and the groove 59 formed thereby, as well as the living hinge 39 formed thereby, all extend longitudinally of the mold throughout the complete width of the door member.

The lower mold part 101 illustrated in FIG. 15A is also shown as having a compression block 118 projecting upwardly therefrom so as to effect additional compression and hence reduction in thickness of the front door panel 37 in the vicinity of the living hinge. This compression block also extends lengthwise of the door panel and results in sufficient additional compression of the mat so as to provide the upper region of the door panel 37, in the vicinity of the living hinge 39, with increased strength and rigidity so as to maintain the desired curvature and strength along the upper edge of the front door panel.

While forming the fiber mat into the door member of the present invention utilizing mold features and process steps similar to that illustrated by FIG. 15A is believed desirable with respect to providing an aesthetically pleasing door member having durable hinging characteristics, it will be apparent that other variations and modifications of the living hinge and the process for forming it may also be used.

While the door member can be formed as a one-piece homogeneous member of a molded fibrous material as discussed above, it will be appreciated that in many instances there is a desire to provide the door member with a decorative covering. Accordingly, the door member of the present invention when formed of the compressed fibrous material can also have a sheet of thin flexible fabric 70 positioned to extend coextensively over the exterior surface of the molded door member. This thin fabric sheet 70, which may comprise either cloth or vinyl fabric, will preferably be adhered to the exterior surface of the molded door member so as to extend coextensively thereover, including along the living hinges, with the fabric being positioned in the mold along with the heated fibrous mat so that the fabric effectively bonds to the compressed homogeneous mat during forming of the door member in the mold. The covering typically will have a thickness of about 0.060 inch and, due to its thinness and flexibility, will not severely or adversely impact the flexing properties of the living hinges 39 and 63.

While the exposed (i.e. exterior) surface of the one-piece door member 36 may be defined by the compressed fibrous mat, it will be appreciated that the exterior surface can also be provided with a conventional thin flexible fabric covering thereover, such as cloth or vinyl, which covering can be bonded to the exterior surface of the door member, preferably during the molding of the door member within the mold. This hence provides significantly increased flexibility with respect to the overall aesthetic appearance of the door member when positioned in an office environment.

The door member can also be provided with suitable three-dimensional relief or design configurations formed particularly in the front surface of the front door panel, such being possible by providing molded in tool features or configurations in the mold so that such configurations are molded directly into the door member during compression of the fibrous mat.

Figure 18:
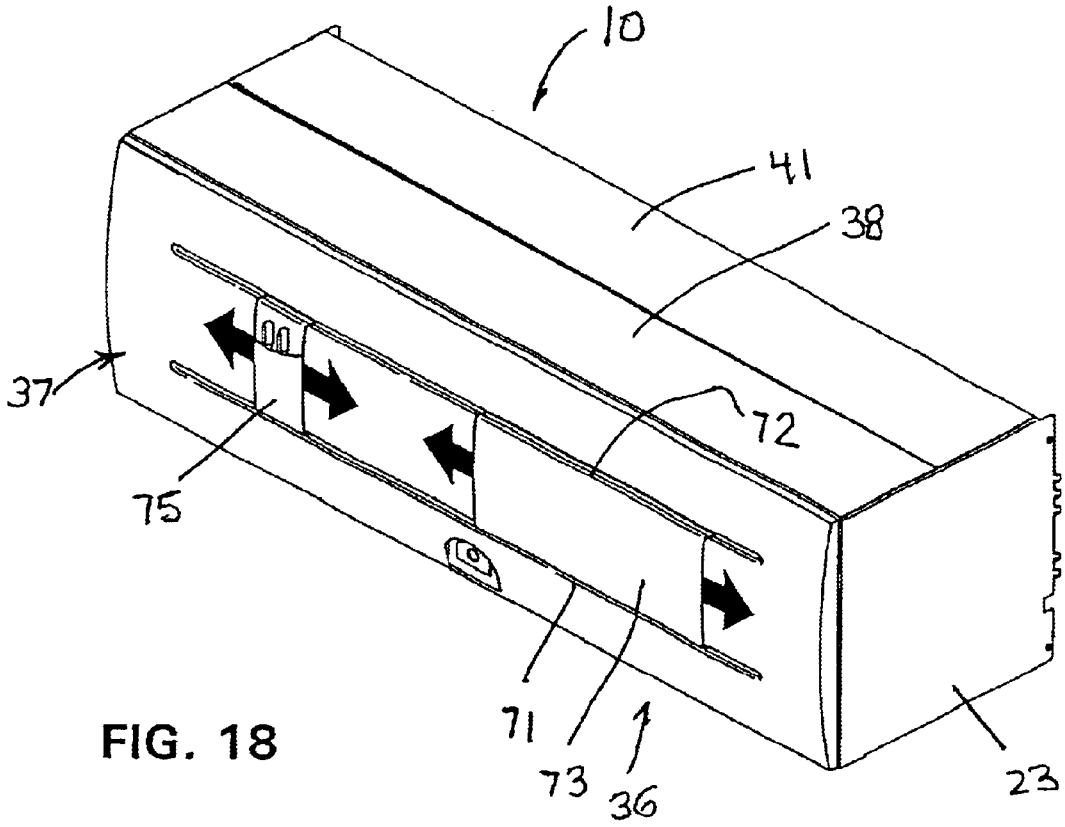
FIGS. 18 and 19 respectively illustrate the door of the present invention in closed and open positions, and specifically illustrates a modification of the door so as to permit accessories or tools to be mounted thereon.
Figure 19:
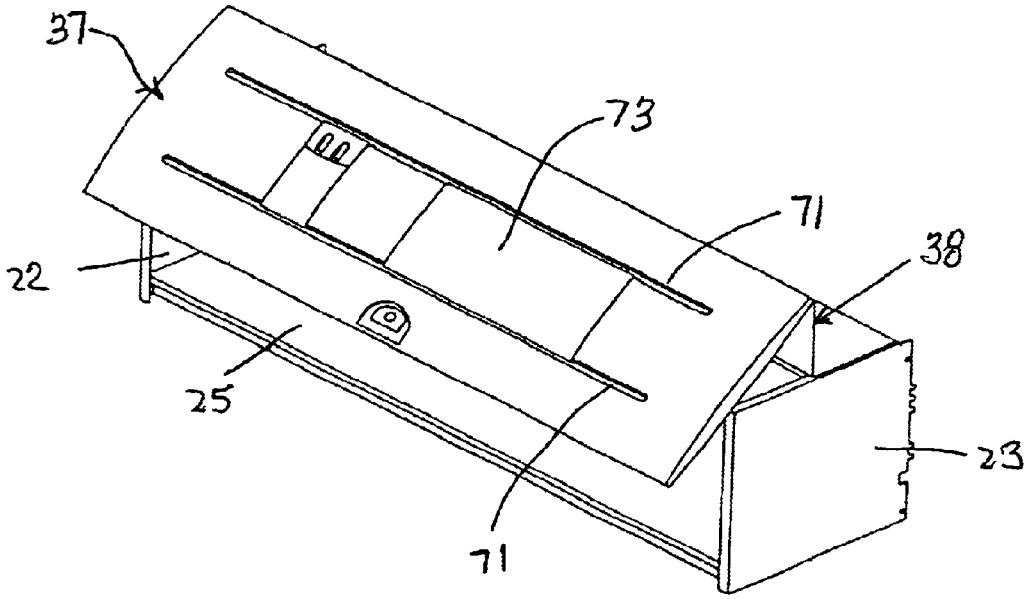
Figure 20:
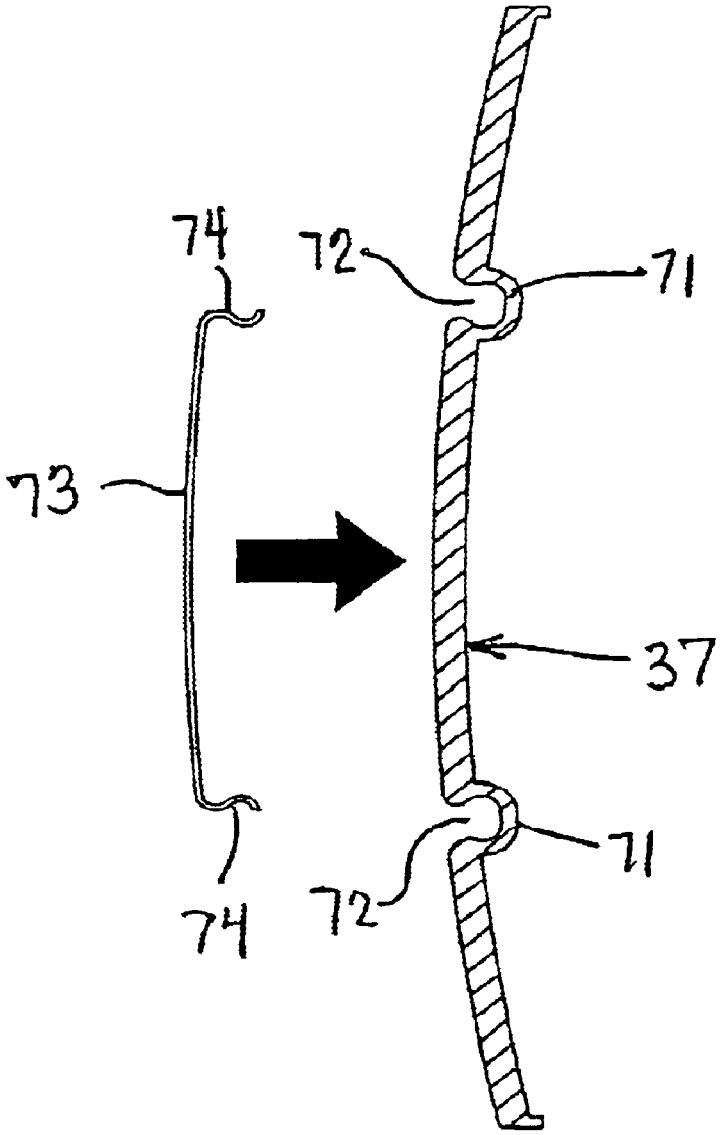
FIG. 20 is an enlarged fragmentary sectional view illustrating one proposal for modifying the front of the door to accommodate accessories or tools.
Figure 21:
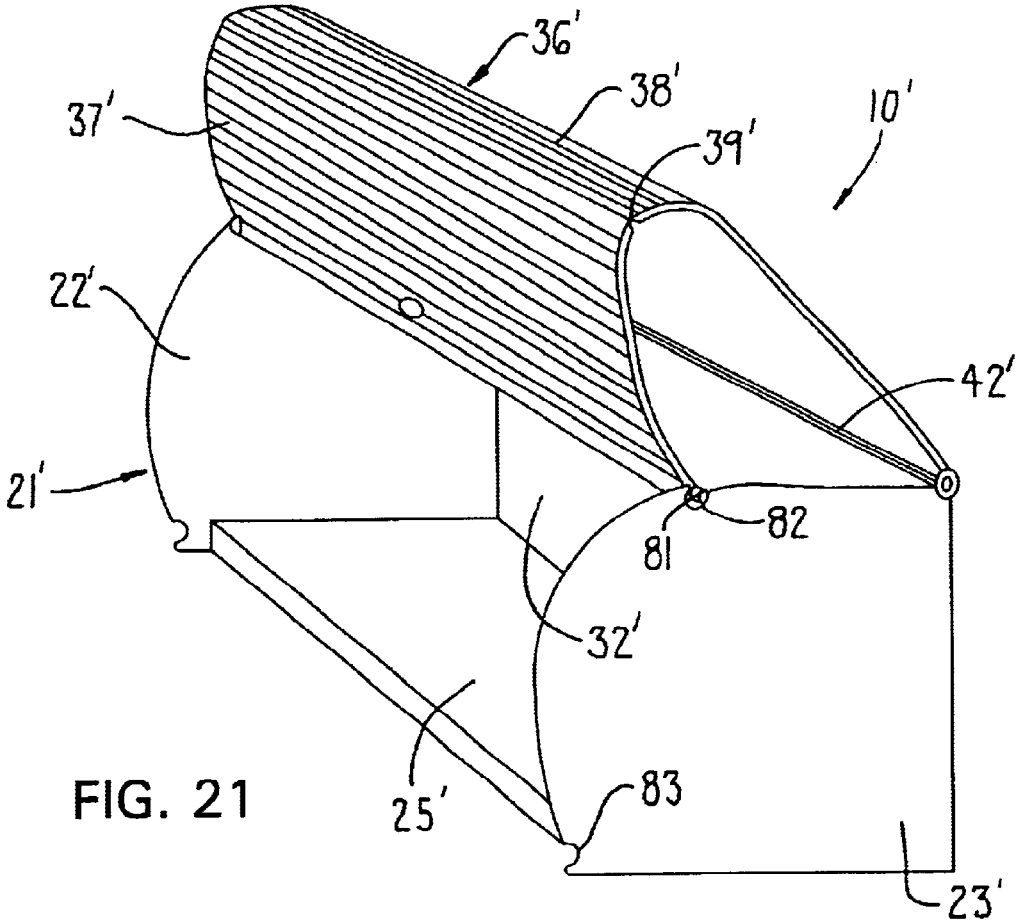
FIG. 21 is a perspective view which diagrammatically illustrates a modified storage cabinet according to the present invention and showing the door in an open position.

Referring now to FIGS. 18–20, there is illustrated a modification of the lower panel 37 of the door member 32 so as to permit mounting of office tools or accessories thereon. In this illustrated variation, the door member 32, during molding thereof, can be provided with three-dimensional tool-mounting structures 71 which are formed integrally and monolithically within the door panel. These tool-mounting structures 71 in the illustrated embodiment define a pair of generally parallel and elongate grooves 72 which extend horizontally over a significant length in the longitudinal direction of the door panel 37, and are vertically spaced apart, whereby the grooves are readily accessible from the front exterior side of the cabinet. These grooves 72 can be utilized to accommodate various removable tool accessories, which can be attached to the door by means of attachment strips or elements 73 which have appropriate metal or plastic flanges 74 associated therewith for releasable engagement within the grooves 72. The mounting plate 73 can be provided with various tool accessories attached thereto, such as a pocket 75 for mounting pencils or other objects therein. The attachment element 73 can also have a tackable or a whiteboard strip attached to the exterior surface thereof. Alternatively, larger tools or accessories such as an erasable marker board can be provided with clips on the rear thereof similar to the mounting plates 73 so as to be releasably engageable within the grooves 72. It will be appreciated that a wide variety of tools or accessory products can be releasably attached to the front of the door panel 37.

The tool mountings 71 will be formed in the door panel preferably simultaneous with the compression of the heated mat within the mold so as to provide the formed door member 32 and specifically the lower door panel 38 with the desired strength and rigidity. While FIG. 20 illustrates only one form for defining the tool mountings, namely elongate grooves, it will be appreciated that numerous other shapes and configurations can also be formed in the door panel so as to permit mounting of tools thereon. For example, rather than providing grooves, it will be appreciated that the tool mountings 71 can be protruded outwardly from the front side of the door, rather than inwardly, thereby defining projections or ribs.

Regarding the cabinet housing, it will be appreciated that the end panels 22–23 can assume many known and conventional configurations and materials. For example the end panels can be formed by being shaped from thin metal sheet with the edges of the end panels being defined by suitably shaped flanges associated with the metal sheet, such being well known. Alternatively, the end panels can be defined by platelike wood members such as particle board or the like having appropriate plastic laminates secured to the exterior thereof, such also being well known.

The cabinet housing can also be provided with a back wall so as to close off the back side of the storage compartment if desired, although in most situations such back wall is not required inasmuch as the back of the cabinet is appropriately closed off by the front surface of the upright wall to which the cabinet is mounted.

While the door member 36 as described above has the mounting flange 41 shaped so as to extend over and around the rear edge of the top wall member 16 of the cabinet, it will be appreciated that the mounting flange 41 of the door member can also be of smaller extent so as to overlie and attach to the top wall member of the cabinet solely along the front flange thereof or solely along a front portion of the top wall thereof.

Referring now to FIGS. 21 and 22A–22C, there is illustrated a modified overhead storage cabinet 10' which utilizes an openable door 36'. In this variation the same reference numerals are utilized to designate corresponding parts of the invention as previously described, except for the addition of a prime (') thereto.

In this variation, the door 36' is of a generally bifold construction in that it again includes a lower or front panel 37' connected to an upper or top panel 38' through a longitudinally extending living hinge 39' which joins the panels 37' and 38' together. The panel 38' at its rearward edge is provided with a hinge 42' which may be defined by an elongate rod which couples to the cabinet side walls 22' and 23' adjacent the upper rear corners thereof, or alternatively the hinge 42' may be a horizontally elongate living hinge which couples the door panel 38' to a mounting flange or panel 41', the latter being capable of overlying and being adhesively or fixedly secured to a suitable top or rear wall (not shown) associated with the cabinet housing 21'.

Figure 22B:
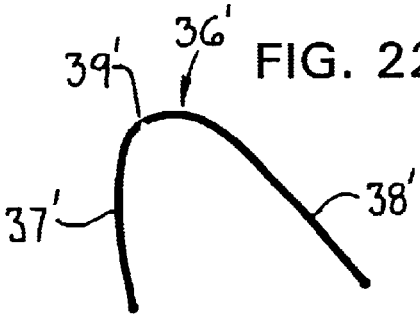
FIGS. 22A, 22B and 22C diagrammatically illustrate solely the side profile of the door associated with the cabinet of FIG. 21 and specifically illustrate the door profile in its closed, open and generally flat conditions, respectively.
Figure 22A:
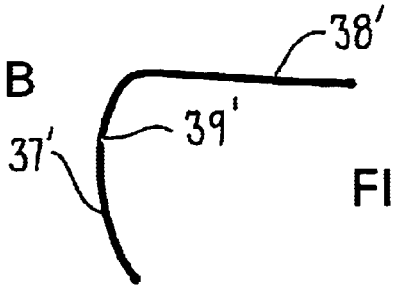
Figure 22C:
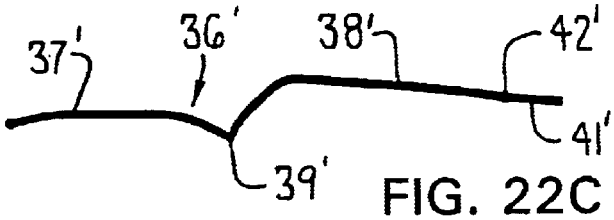

The cabinet housing 21' in this variation has generally the entire front and top sides thereof opening into the interior storage compartment 32', with the door when in the closed position illustrated by FIG. 22A totally closing off the front and top sides of the cabinet so as to close the compartment 32'. Manual movement of the door 36' to the open position illustrated by FIGS. 21 and 22B causes the door to hinge about the hinges 39' and 42' so that the door moves into the open position illustrated by FIG. 21. In this latter position suitable projecting stops or pins 81 as provided on the lower corners of the panel 37' can be engaged within notches or recesses 82 associated with the cabinet end walls 22'–23' to maintain the door 36' in its upwardly projecting opened position. Closure of the door is effected by manually engaging and slightly lifting the lower panel 37' to disengage it from the recesses 82, with the door then being returned to its closed position. The door can be held in its closed position by engaging the stops 81 within additional recesses 83 associated with the lower front corners of the cabinet end panels.

The door 36' is constructed of a fibrous plastic material which is suitably heated and compressed so as to define the panels and the living hinges all as an integral one-piece monolithic construction, as described in greater detail above relative to the door 36.

While the improved door construction and its associated cabinet as described above relates to an arrangement wherein the living hinge or hinges are horizontally oriented so as to permit vertical swinging of the door between opened and closed positions, it will be appreciated that the cabinet structure of the present invention and more specifically the improved swingable door can also be structurally and positionally arranged for different positional and swinging orientations. For example, the door can be oriented relative to a cabinet such that the living hinge extends generally vertically so that the swinging movement of the door about the living hinge occurs generally horizontally when moving between the opened and closed positions.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A storage cabinet, comprising:

a storage housing defining a storage compartment therein and including a pair of laterally spaced upright side walls rigidly joined by a bottom wall and defining an access opening associated with at least a front side of the housing for accessing said interior storage compartment;

a door configured to cover the access opening and removably attached to the storage housing for movement between open and closed positions;

said door comprising a one-piece monolithic door member formed from a relatively rigid but light weight sheet of resin-bonded plastic fibers, and having substantially rigid upper and lower door panels which extend across a width of the housing, said upper and lower door panels being monolithically joined at adjacent widthwise-extending first edges by a generally horizontally and widthwise-extending first living hinge which permits the upper and lower door panels to be relatively hingedly moved through a significant angular extent about said first living hinge;

said lower door panel, when the door is in said closed position, being disposed in a generally upright position to at least partially close off said access opening whereby a lower free edge of said lower door panel is disposed adjacent a lower edge of said access opening and said first living hinge is disposed more closely adjacent an upper extremity of said access opening;

said monolithic one-piece door member also including a mounting part which is monolithically joined to said upper door panel at a widthwise edge thereof which is remote from said first living hinge, said mounting part being joined to said housing adjacent a top thereof to define a second hinge which is transversely spaced from but substantially parallel to said first living hinge;

whereby said door can be hingedly moved about said first and second hinges from said closed position into said open position wherein said upper and lower door panels are positioned generally in overlapping relationship to one another adjacent a top side of said housing.

2. A storage cabinet, comprising:

a storage housing defining a storage compartment therein and including a pair of laterally spaced upright side walls rigidly joined by a bottom wall and defining an access opening associated with at least a front side of the housing for accessing said interior storage compartment;

a door configured to cover the access opening and removably attached to the storage housing for movement between open and closed positions;

said door comprising a one-piece monolithic door member constructed of compressed light-weight fibrous material and having substantially rigid upper and lower door panels which extend across a width of the housing, said upper and lower door panels being monolithically joined at adjacent widthwise-extending first edges by a generally horizontally and widthwise-extending first living hinge which permits the upper and lower door panels to be relatively hingedly moved through a significant angular extent about said first living hinge;

said lower door panel when the door is in the closed position having a depth as defined between the widthwise-extending edges thereof which is significantly greater than the depth of the upper door panel as defined between the widthwise-extending edges thereof, and being disposed in a generally upright position to at least partially close off said access opening whereby a lower free edge of said lower door panel is disposed adjacent a lower edge of said access opening and said first living hinge is disposed more closely adjacent an upper extremity of said access opening;

said monolithic one-piece door member also including a mounting part which is monolithically joined to said upper door panel at a widthwise edge thereof which is remote from said first living hinge, said mounting part being joined to said housing adjacent a top thereof to define a second hinge which is transversely spaced from but substantially parallel to said first living hinge;

whereby said door can be hingedly moved about said first and second hinges from said closed position into said open Position wherein said upper and lower door panels are positioned generally in overlapping relationship to one another adjacent a top side of said housing, and wherein said door member when in said open position is disposed with said upper door panel in a generally horizontal orientation and projecting rearwardly from said second hinge and said lower door panel also being disposed in a generally horizontal orientation disposed above said upper door panel and projecting forwardly from said second hinge such that a free edge of said lower door panel is disposed adjacent a front upper corner of the housing so as to be readily manually accessible.

3. A storage cabinet according to claim 2, wherein said access opening includes a main front opening portion which extends vertically along the front side of the housing and which joins to a top opening portion which projects inwardly from the front upper corner of the cabinet housing and projects rearwardly over a part of the width of the top of the cabinet housing, said second hinge being disposed adjacent a rearward edge of said top opening portion so that said upper door panel closes said top opening portion when the door is in said closed position.

4. A storage cabinet according to claim 3, wherein said second hinge is disposed generally at the top of said housing approximately midway between front and rear upper edges thereof, and said upper door panel having a transverse width which generally corresponds to the transverse width of the top opening portion so that said first hinge is disposed generally at the front upper edge of the cabinet housing when the door is in said closed position, said first hinge being disposed closely adjacent a rear upper edge of the housing when the door is in the opened storage position.

5. A storage cabinet according to claim 4, wherein said upper door panel includes a horizontally extending large center panel part having a first thickness, said center panel part being provided with edge parts associated with opposite ends thereof and disposed for supportive engagement with upper edges of the side walls when the door is in the closed position, and said lower door panel having a main center panel part which covers most of the vertical and horizontal extent of the front opening portion and which has a thickness which is significantly less than the thickness of said main center panel part of said upper door panel.

6. A storage cabinet according to claim 4, wherein said cabinet housing includes a top wall which extends between and is rigidly joined to said side walls and is disposed in generally upwardly spaced and parallel relationship with said bottom wall, said top wall having a transverse width which is substantially smaller than said bottom wall so that said top wall closes off only a rearward portion of the top of said housing, a front portion of the top of said housing being open and effectively defining an upper expansion of said access opening, and the mounting part of said door member including a main covering panel which overlies and covers said top wall, said covering panel at a front widthwise-extending edge thereof being monolithically joined to a rear widthwise-extending edge of said upper door panel by a monolithic second living hinge which defines said second hinge.

7. A storage cabinet, comprising:

a storage housing defining a storage compartment therein and including a pair of laterally spaced upright side walls rigidly joined by a bottom wall and defining an access opening associated with at least a front side of the housing for accessing said interior storage compartment;

a door configured to cover the access opening and removably attached to the storage housing for movement between open and closed positions;

said door comprising a one-piece monolithic door member constructed of compressed light-weight fibrous material and having substantially rigid upper and lower door panels which extend across a width of the housing, said upper and lower door panels being monolithically joined at adjacent widthwise-extending first edges by a generally horizontally and widthwise-extending first living hinge which permits the upper and lower door panels to be relatively hingedly moved through a significant angular extent about said first living hinge, the door member including a flange which is monolithically joined to the lower edge of said lower door panel and which is cantilevered inwardly through a small extent for closing off a lower edge of said access opening;

said lower door panel, when the door is in said closed position, being disposed in a generally upright position to at least partially close off said access opening whereby a lower free edge of said lower door panel is disposed adjacent a lower edge of said access opening and said first living hinge is disposed more closely adjacent an upper extremity of said access opening;

said monolithic one-piece door member also including a mounting part which is monolithically joined to said upper door panel at a widthwise edge thereof which is remote from said first living hinge, said mounting part being joined to said housing adjacent a top thereof to define a second hinge which is transversely spaced from but substantially parallel to said first living hinge;

whereby said door can be hingedly moved about said first and second hinges from said closed position into said open position wherein said upper and lower door panels are positioned generally in overlapping relationship to one another adjacent a top side of said housing.

8. A storage cabinet according to claim 7, wherein said flange extends along the entire length of the lower free edge of the lower door panel and adjacent opposite ends thereof, is provided with tapered edge surfaces which cooperate with opposed surfaces defined on the cabinet housing adjacent lower front corners thereof for effecting recentering of the door member when in the closed position.

9. A storage cabinet according to claim 1, wherein said door member is formed from a mat defined by said mixture, said fibers comprise PET fibers, and said mat is heated and compressed in a mold to define said molded door member.

10. A storage cabinet, comprising:

a storage housing defining a storage compartment therein and including a pair of laterally spaced upright side walls rigidly joined by a bottom wall and defining an access opening associated with at least a front side of the housing for accessing said interior storage compartment;

a door configured to cover the access opening and removably attached to the storage housing for movement between open and closed positions;

said door comprising a one-piece monolithic door member constructed of compressed light-weight fibrous material and having substantially rigid upper and lower door panels which extend across a width of the housing, said upper and lower door panels being monolithically joined at adjacent widthwise-extending first edges by a generally horizontally and widthwise-extending first living hinge which permits the upper and lower door panels to be relatively hingedly moved through a significant angular extent about said first living hinge, -said lower door panel having cantilevered edge flanges monolithically joined thereto and projecting inwardly from at least the vertically extending edges thereof;

said lower door panel, when the door is in said closed position, being disposed in a generally upright position to at least partially close off said access opening whereby a lower free edge of said lower door panel is disposed adjacent a lower edge of said access opening and said first living hinge is disposed more closely adjacent an upper extremity of said access opening, and said edge flanges of said lower door panel being positioned for abutting engagement with front edge surfaces defined on said side walls when the door is in the closed position;

said monolithic one-piece door member also including a mounting part which is monolithically joined to said upper door panel at a widthwise edge thereof which is remote from said first living hinge, said mounting part being joined to said housing adjacent a top thereof to define a second hinge which is transversely spaced from but substantially parallel to said first living hinge;

whereby said door can be hingedly moved about said first and second hinges from said closed position into said open position wherein said upper and lower door panels are positioned generally in overlapping relationship to one another adjacent a top side of said housing.

11. A storage, comprising:

a storage housing defining a storage compartment therein and including a pair of laterally spaced upright side walls rigidly joined by a bottom wall and defining an access opening associated with at least a front side of the housing for accessing said interior storage compartment;

a door configured to cover the access opening and removably attached to the storage housing for movement between open and closed positions;

said door comprising a one-piece monolithic door member constructed of compressed light-weight fibrous material and having substantially rigid upper and lower door panels which extend across a width of the housing, said upper and lower door panels being monolithically joined at adjacent widthwise-extending first edges by a generally horizontally and widthwise-extending first living hinge which permits the upper and lower door panels to be relatively hingedly moved through a significant angular extent about said first living hinge, the transverse width of the lower door panel being approximately twice the transverse width of the upper door panel;

said lower door panel, when the door is in said closed position, being disposed in a generally upright position to at least partially close off said access opening whereby a lower free edge of said lower door panel is disposed adjacent a lower edge of said access opening and said first living hinge is disposed more closely adjacent an upper extremity of said access opening;

said monolithic one-piece door member also including a mounting part which is monolithically joined to said upper door panel at a widthwise edge thereof which is remote from said first living hinge, said mounting part being joined to said housing adjacent a top thereof to define a second hinge which is transversely spaced from but substantially parallel to said first living hinge;

whereby said door can be hingedly moved about said first and second hinges from said closed position into said open position wherein said upper and lower door panels are positioned generally in overlapping relationship to one another adjacent a top side of said housing.

12. A storage cabinet, comprising:

a storage housing defining a storage compartment therein and including a pair of laterally spaced upright side walls rigidly joined by a bottom wall and defining an access opening associated with at least a front side of the housing for accessing said interior storage compartment, said storage housing having securing structure associated with a rear side thereof for permitting the cabinet to be fixedly attached to a front vertical surface of an upright wall so that the cabinet is fixedly supported on but cantilevered horizontally outwardly from the wall;

a door configured to cover the access opening and removably attached to the storage housing for movement between open and closed positions;

said door comprising a one-piece monolithic door member constructed of compressed light-weight fibrous material and having substantially rigid upper and lower door panels which extend across a width of the housing, said upper and lower door panels being monolithically joined at adjacent widthwise-extending first edges by a generally horizontally and widthwise-extending first living hinge which permits the upper and lower door panels to be relatively hingedly moved through a significant angular extent about said first living hinge;

said lower door panel, when the door is in said closed position, being disposed in a generally upright position to at least partially close off said access opening whereby a lower free edge of said lower door panel is disposed adjacent a lower edge of said access opening and said first living hinge is disposed more closely adjacent an upper extremity of said access opening;

said monolithic one-piece door member also including a mounting part which is monolithically joined to said upper door panel at a widthwise edge thereof which is remote from said first living hinge, said mounting part being joined to said housing adjacent a top thereof to define a second hinge which is transversely spaced from but substantially parallel to said first living hinge;

whereby said door can be hingedly moved about said first and second hinges from said closed position into said open position wherein said upper and lower door panels are positioned generally in overlapping relationship to one another adjacent a top side of said housing.

13. A storage cabinet for securement adjacent a side surface of an upright wall so that the storage cabinet is supported on and cantilevered outwardly from the wall, said storage cabinet comprising:

a housing defining an interior storage compartment, said housing including a pair of laterally spaced and generally parallel upright side walls and a generally horizontally-oriented bottom wall which extends between and is rigidly joined to said side walls adjacent lower edges thereof, whereby said side walls project upwardly a significant extent above said bottom wall;

said storage housing defining a front access opening which extends generally horizontally between said end panels and which projects upwardly from said bottom wall throughout substantially the height of the end panels for providing access to said interior storage compartment;

a door configured to cover the front access opening and removably attached to the housing for pivoting movement between a closed position wherein the door closes off said front access opening and an opened position wherein the door is stored generally horizontally overhead of said compartment;

said door including upper and lower door panels which both extend generally lengthwise of the housing and which have adjacent lengthwise edges which are joined by a first hinge structure which defines a first generally horizontally elongated hinge axis which extend generally parallel with said horizontal bottom wall, said lower door panel being positioned generally vertically within said front access opening when the door is in said closed position so that a lower lengthwise-extending free edge of said lower door panel is positioned adjacent the lower edge of said front access opening, and said upper door panel having its other lengthwise-extending edge joined to a second hinge structure which connects to said housing and defines a second generally horizontally extending hinge axis which is generally parallel with said first hinge axis and is disposed adjacent the upper edges of said end panels and is approximately midway between front and back sides of said housing; and said lower door panel having a transverse width as defined between the horizontally-elongated lengthwise edges thereof which is significantly greater than the width of the upper door panel as defined between the horizontally-elongated lengthwise edges thereof;

said door when in said closed position being disposed so that said lower door panel is positioned generally vertically so as to close off said front access opening and said upper door panel is positioned to extend generally horizontally so as to overlie the top of said housing adjacent a front side thereof, whereby hinging movement of said door into said opened position causes said upper door panel to hinge upwardly and rearwardly about said second axis so as to substantially horizontally overlie the top of said housing adjacent a rear side thereof while simultaneously causing said lower door panel to swing upwardly and generally horizontally overlie said upper door panel so that the free edge of said lower door panel is disposed adjacent an upper front edge of said housing.

14. A storage cabinet according to claim 13, wherein said upper and lower door panels are integrally and monolithically joined by a living hinge which defines said first hinge structure.

15. A storage cabinet according to claim 14, wherein said door is formed as a monolithic one-piece member constructed of a lightweight but relatively rigid fibrous material.

16. A storage cabinet according to claim 13, wherein said housing includes a top wall which is disposed in generally parallel and upwardly spaced relationship from said bottom wall and which extends generally horizontally between and is rigidly joined to said side panels adjacent upper edges thereof, and said second hinge structure being joined between said top wall and said upper door panel.

17. A storage cabinet according to claim 16, wherein said top wall extends across approximately only a rearward half of the top of said housing, and the approximately forward half of the top of said housing being a continuous opening extension with said front access opening and being closed by said upper door panel when said door is in said closed position.

18. A storage cabinet according to claim 17, wherein said top wall includes a stationary top panel which is integrally and monolithically joined to said upper door panel by a living hinge which defines said second hinge structure.

19. A storage cabinet according to claim 18, wherein said upper and lower door panels are integrally and monolithically joined by a living hinge which defines said first hinge structure.

20. A storage cabinet according to claim 19, wherein said door is formed as a monolithic one-piece member constructed of a lightweight but relatively rigid fibrous material.

21. A storage cabinet including a housing defining therein an interior storage compartment and having an access opening associated with a front side of the housing for providing access into said storage compartment, a securing structure associated with a rear side of said housing for permitting the cabinet to be fixedly attached to a front vertical surface of an upright wall, and a door swingably mounted relative to the housing and cooperating with the access opening for movement between a closed position wherein the door covers the access opening and an open position wherein the access opening is not covered by the door, said door comprising:

a one-piece monolithic door member constructed of compressed light-weight fibrous material and having a plurality of substantially rigid door panels including first and second panels which are monolithically joined at adjacent edges by an elongate living hinge which permits the first panel to be relatively hingedly moved through an angular extent about said living hinge, one of said door panels being fixedly mounted with respect to said storage housing, and said first door panel being positioned for swinging movement between said open and closed positions relative to said access opening.

22. A storage cabinet according to claim 21, wherein said door member is formed from a mat defined by a mixture of plastic fibers and resin, said mat being heated and compressed in a mold to define said door member.

23. A storage cabinet including a housing defining therein an interior storage compartment and having an access opening associated with a side of the housing for providing access into said storage compartment, and a door swingably mounted relative to the housing and cooperating with the access opening for movement between a closed position wherein the door covers the access opening and an open position wherein the access opening is not covered by the door, said door comprising:

a one-piece monolithic door member constructed of compressed light-weight fibrous material and having a plurality of substantially rigid door panels including first and second panels which are monolithically joined at adjacent edges by an elongate living hinge which permits the first panel to be relatively hingedly moved through an angular extent about said living hinge, and a thin flexible fabric sheet positioned coextensively over and bonded to the exterior surface of said door member so that said sheet extends exteriorly over said first and second panels and also extends coextensively across said living hinge, one of said door panels being fixedly mounted with respect to said storage housing, and said first door panel being positioned for swinging movement between said open and closed positions relative to said access opening.

24. A storage cabinet according to claim 22, wherein said living hinge is disposed so as to be approximately flush with either adjacent exterior surfaces or adjacent interior surfaces of said first and second door panels.

25. A storage cabinet according to claim 24, wherein said living hinge has a thickness in the range of between about 0.020 inch and about 0.035 inch.

26. A storage cabinet including a housing defining therein an interior storage compartment and having an access opening associated with a side of the housing for providing access into said storage compartment, and a door swingably mounted relative to the housing and cooperating with the access opening for movement between a closed position wherein the door covers the access opening and an open position wherein the access opening is not covered by the door, said door comprising:

a one-piece monolithic door member constructed of compressed light-weight fibrous material and having a plurality of substantially rigid door panels including first and second panels which are monolithically joined at adjacent edges by an elongate living hinge which permits the first panel to be relatively hingedly moved through an angular extent about said living hinge, one of said door panels being fixedly mounted with respect to said storage housing, and said other door panel having tool mounting structures integrally and rigidly molded therein and protruding transversely relative to the door panel so as to permit tools or accessories to be removably attached thereto, and said first door panel being positioned for swinging movement between said open and closed positions relative to said access opening.

27. A storage cabinet according to claim 26, wherein the tool mounting structures define a pair of generally horizontally elongated and vertically spaced grooves which are formed in said other door panel and which open inwardly from an exterior surface thereof, and a tool accessory having a rearwardly projecting flange structure engaged within said grooves.

28. A process for forming a door which is swingably mountable on a storage cabinet, comprising the steps of:

providing a mold having opposed first and second mold parts defining therebetween a mold cavity which defines the shape of the door when the mold parts are in a closed position;

providing one of the mold parts with an elongate groove-like recess which has a mouth portion which communicates with the mold cavity;

providing the other mold part with a thin forming blade which projects from the other mold part into the mold cavity so that a tip portion of the forming blade is positioned generally at or within the mouth of the groovelike recess but is spaced from defining walls thereof;

positioning a mat of fibrous material containing a resin binder therein in the mold cavity associated with one of the mold parts;

thereafter relatively moving the mold parts into a closed position to close the mold cavity and effect compression of the fibrous mat and reshaping thereof into the door;

causing the forming blade, during closing of the mold, to effect localized compression of the mat so that the thickness of the mat is significantly reduced and defines a reduced-thickness arcuate hinge portion which wraps around the tip of the blade and is pushed into the recess but is spaced from an end wall thereof so as to control compression of the arcuate hinge portion and thereby define a living hinge;

removing the formed door from the mold; and connecting the formed door to a cabinet housing having an access opening for communication with an interior storage compartment so that the door couples to the cabinet and one panel of the door as joined to said living hinge is swingable about said living hinge between open and closed positions relative to said access opening.

29. A process according to claim 28, wherein said tip portion of said blade has opposed side walls which are tapered so as to converge as they project toward a rounded free end of the blade, and wherein a mouth of the groovelike recess has sloped walls which flare outwardly as they merge with the mold cavity, whereby compression of the mat by the tip of the blade and its cooperation with the recess results in formation of thin compressed hinge parts which join to the curved hinge portion and project outwardly in diverging relationship through small clearance cavities defined between the sloped side walls of the blade and the opposed sloped side walls defined by the mouth of the recess.

30. A storage cabinet according to claim 1, wherein said side walls are made from a different material than said door member.

* * * * *